US011854731B2

(12) United States Patent
Ogasawara

(10) Patent No.: US 11,854,731 B2
(45) Date of Patent: Dec. 26, 2023

(54) COIL COMPONENT AND ELECTRONIC DEVICE

(71) Applicant: TAIYO YUDEN CO., LTD., Tokyo (JP)

(72) Inventor: Jun Ogasawara, Takasaki (JP)

(73) Assignee: TAIYO YUDEN CO., LTD., Tokyo (JP)

( * ) Notice: Subject to any disclaimer, the term of this patent is extended or adjusted under 35 U.S.C. 154(b) by 827 days.

(21) Appl. No.: 16/552,914

(22) Filed: Aug. 27, 2019

(65) Prior Publication Data

US 2020/0075222 A1 Mar. 5, 2020

(30) Foreign Application Priority Data

Aug. 31, 2018 (JP) ..... 2018-163409
Aug. 13, 2019 (JP) ..... 2019-148383

(51) Int. Cl.
*H01F 17/04* (2006.01)
*H01F 27/28* (2006.01)
*H01F 27/255* (2006.01)
*H01F 27/29* (2006.01)

(52) U.S. Cl.
CPC ..... *H01F 27/2804* (2013.01); *H01F 27/255* (2013.01); *H01F 27/29* (2013.01)

(58) Field of Classification Search
CPC ..... H01F 27/2804; H01F 27/29
USPC ..... 336/221
See application file for complete search history.

(56) References Cited

U.S. PATENT DOCUMENTS 6,154,028 A * 11/2000 Bushida ..... G01R 33/02 324/253
2002/0097124 A1 7/2002 Inoue et al.
2013/0135072 A1* 5/2013 Inaba ..... H01F 3/08 336/90
2013/0229251 A1 9/2013 Liao et al.
2014/0253275 A1 9/2014 Shijo et al.
(Continued)

FOREIGN PATENT DOCUMENTS

JP 2002305108 A 10/2002
JP 2005310812 A 11/2005
(Continued)

OTHER PUBLICATIONS

A Notice of Reasons for Refusal issued by the Japanese Patent Office, dated Apr. 5, 2022, for Japanese related application No. 2018-163410. (5 pages).
(Continued)

*Primary Examiner* — Ronald Hinson
(74) *Attorney, Agent, or Firm* — Law Office of Katsuhiro Arai

(57) ABSTRACT

A coil component includes: a substrate body having a first resin part formed by a resin that contains magnetic grains, and a second resin part joined to the surface of the first resin part and formed by a resin that contains filler, and whose resin content is higher than that of the first resin part; a coil embedded at least in a part of the first resin part and formed by a conductor having an insulating film; leader parts formed by the conductor and led out from the coil to the second resin part; and terminal parts connected electrically to the leader parts and provided in the second resin part. The above structures can enhance mechanical strength.

17 Claims, 21 Drawing Sheets

(56) References Cited

U.S. PATENT DOCUMENTS

| | | | | |
|---|---|---|---|---|
| 2015/0070120 | A1* | 3/2015 | Nishio | H01F 41/005 29/606 |
| 2015/0270064 | A1* | 9/2015 | Sakamoto | H01F 27/022 29/605 |
| 2015/0371752 | A1* | 12/2015 | Park | H01F 27/255 336/200 |
| 2016/0307694 | A1 | 10/2016 | Ohtsubo et al. | |
| 2017/0133143 | A1* | 5/2017 | Maeda | H01F 41/0246 |
| 2017/0162319 | A1 | 6/2017 | Otani et al. | |
| 2017/0186528 | A1 | 6/2017 | Otsubo et al. | |
| 2018/0012698 | A1 | 1/2018 | Nakatsuji et al. | |
| 2018/0182531 | A1* | 6/2018 | Muneuchi | H01F 27/255 |
| 2019/0088413 | A1 | 3/2019 | Kawaguchi et al. | |
| 2019/0189341 | A1 | 6/2019 | Konishi | |

FOREIGN PATENT DOCUMENTS

| | | | |
|---|---|---|---|
| JP | 2009200435 | A | 9/2009 |
| JP | 2012060053 | A | 3/2012 |
| JP | 2016009858 | A | 1/2016 |
| JP | 2016167576 | A | 9/2016 |
| JP | 2017183678 | A | 10/2017 |
| JP | 2017199732 | A | 11/2017 |
| JP | 2018107199 | A | 7/2018 |
| WO | 2015115024 | A1 | 8/2015 |

OTHER PUBLICATIONS

Notice of Allowance issued by the U.S. Patent and Trademark Office, dated Mar. 31, 2022, for U.S. Appl. No. 16/546,909 (8 pages).

Ex Parte Quayle Action issued by U.S. Patent and Trademark Office, dated Jan. 21, 2022, for U.S. Appl. No. 16/546,909. (11 pages).

A Notice of Reasons for Refusal issued by the Japanese Patent Office, dated May 9, 2023, for Japanese related application No. 2019-148383. (3 pages).

* cited by examiner

COIL COMPONENT AND ELECTRONIC DEVICE

CROSS-REFERENCE TO RELATED APPLICATIONS

The present application claims priority to Japanese Patent Application No. 2018-163409, filed Aug. 31, 2018, and No. 2019-148383, filed Aug. 13, 2019, each disclosure of which is incorporated herein by reference in its entirety including any and all particular combinations of the features disclosed therein.

BACKGROUND

Field of the Invention

The present invention relates to a coil component and an electronic device

Description of the Related Art

Coil components may receive external forces due to vibration, dropping, and the like. When coil components are installed in automobiles, for example, vibration forces tend to apply to the coil components. Desirably coil components do not break even when external forces apply to the coil components. For example, coil components are known that are each made by joining metal plates to leader parts that have been led out to side faces of a substrate body, and then extending these plates from the side faces, to the bottom face, of the substrate body, in order to improve reliability against vibration (refer to Patent Literature 1, for example).

Also known are coil components whose coil is embedded in a substrate body (resin molded body) and whose terminal part is such that its surface is exposed from the bottom side of the substrate body while the terminal part is embedded at least partially in its thickness direction in the substrate body (refer to Patent Literature 2, for example). Additionally, coil components comprising a drum core or ring core around which a coil is formed and which is bonded to a resin base by means of thermosetting adhesive, are known (refer to Patent Literature 3, for example).

Background Art Literatures

[Patent Literature 1] Japanese Patent Laid-open No. 2005-310812
[Patent Literature 2] Japanese Patent Laid-open No. 2009-200435
[Patent Literature 3] Japanese Patent Laid-open No. 2017-183678

SUMMARY

The present invention represents a coil component comprising: a substrate body having a first resin part formed by a resin that contains magnetic grains (distributed randomly or uniformly in therein in some embodiments), and a second resin part joined to the surface of the first resin part and formed by a resin that contains filler (distributed randomly or uniformly therein in some embodiments), and whose resin content is higher than that of the first resin part; a coil embedded at least in a part of the first resin part and formed by a conductor having an insulating film; leader parts formed by the conductor and led out from the coil to the second resin part; and terminal parts connected electrically to the leader parts and provided in the second resin part.

The present invention represents an electronic device comprising: the aforementioned coil component; and a circuit board on which the coil component is mounted.

BRIEF DESCRIPTION OF THE DRAWINGS

FIG. 1A is a top view, while

FIGS. 2A and 2B are interior perspective side views, while

FIG. 5A is an interior perspective side view of the coil component pertaining to Comparative Example 1, while

FIGS. 6A and 6B are interior perspective side views, while

FIGS. 10A and 10B are interior perspective side views, while

FIG. 15A is a perspective view of the coil component pertaining to Example 5, while

FIG. 16A is an interior perspective side view, while

FIG. 17A is a cross-sectional view of the coil component pertaining to Variation Example 1 of Example 6, while

FIG. 18A is an interior perspective side view, while

FIG. 19A is a cross-sectional view of the coil component pertaining to Variation Example 1 of Example 7, while

20B is a cross-sectional view of the coil component pertaining to Variation Example 3 of Example 7.

Figure 21A:
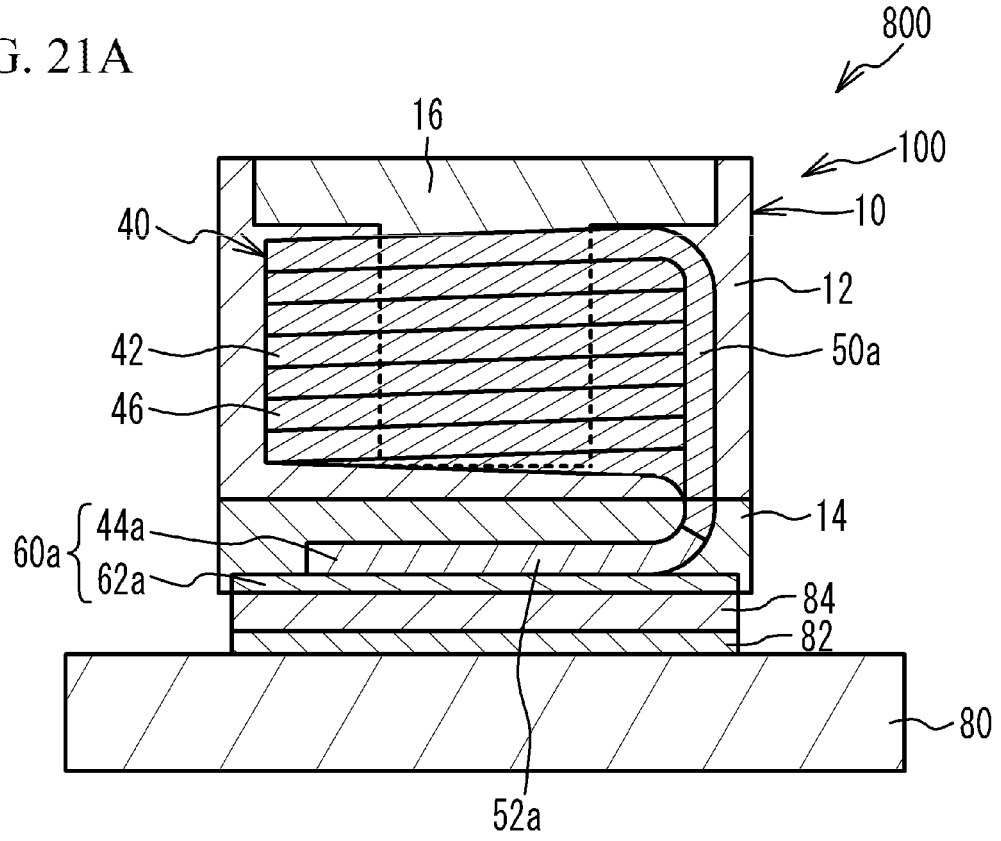
Figure 21B:
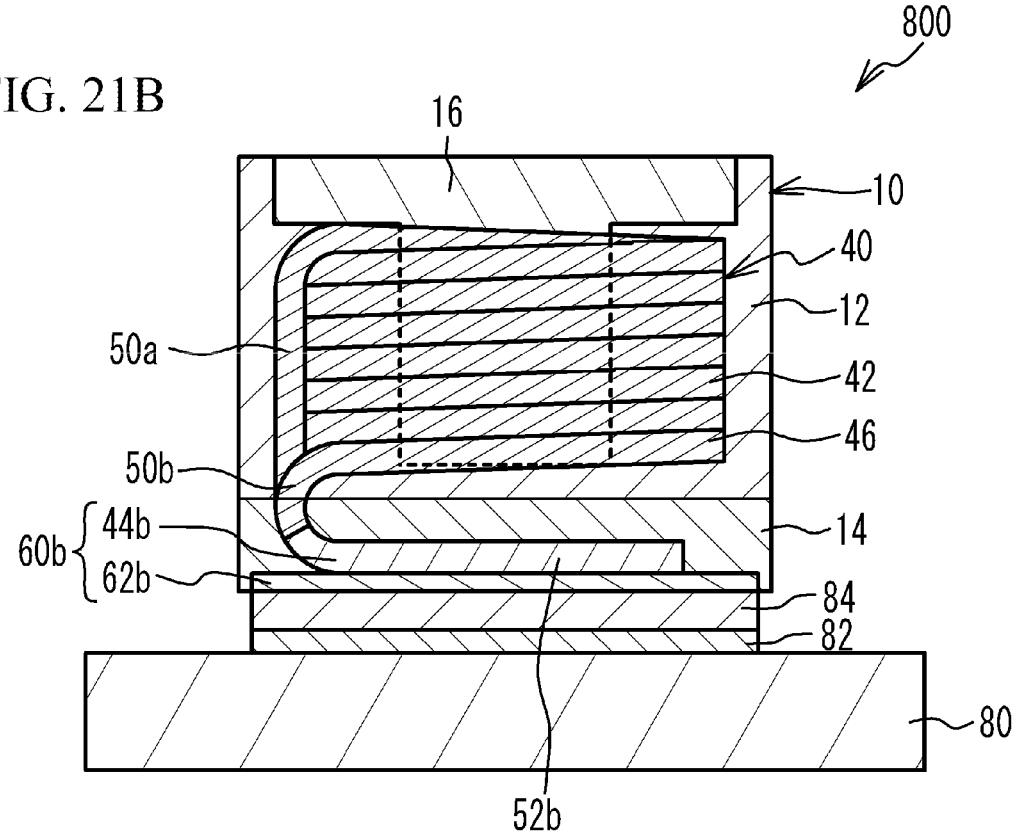

FIGS. 21A and 21B are interior perspective side views of the electronic device pertaining to Example 8.

DESCRIPTION OF THE SYMBOLS

10 Substrate body
12 Resin part
14 Resin part
16, 16*a* Core
17 Axis of winding
18, 18*a*, 18*b* Flange part
20 Top face
22 Bottom face
24*a* to 24*d* Side face
30 Top face
32 Bottom face
34*a* to 34*d* Side face
40 Coil
42 Conductive wire
44*a*, 44*b* Non-covered part
46 Covered part
50*a*, 50*b* Lead wire
52*a*, 52*b* Tip area
60*a*, 60*b* Terminal part
62*a*, 62*b* Metal member
66*a*, 66*b* Opening
70, 76, 78 Die
72, 74 Resin layer
80 Circuit board
82 Electrode
84 Solder
90 Substrate body
92*a*, 92*b* Region
100 to 730 Coil component
800 Electronic device
1000, 1100 Coil component

DETAILED DESCRIPTION OF EMBODIMENTS

Examples of the present invention are explained below by referring to the drawings.

Example 1

Figure 1A:
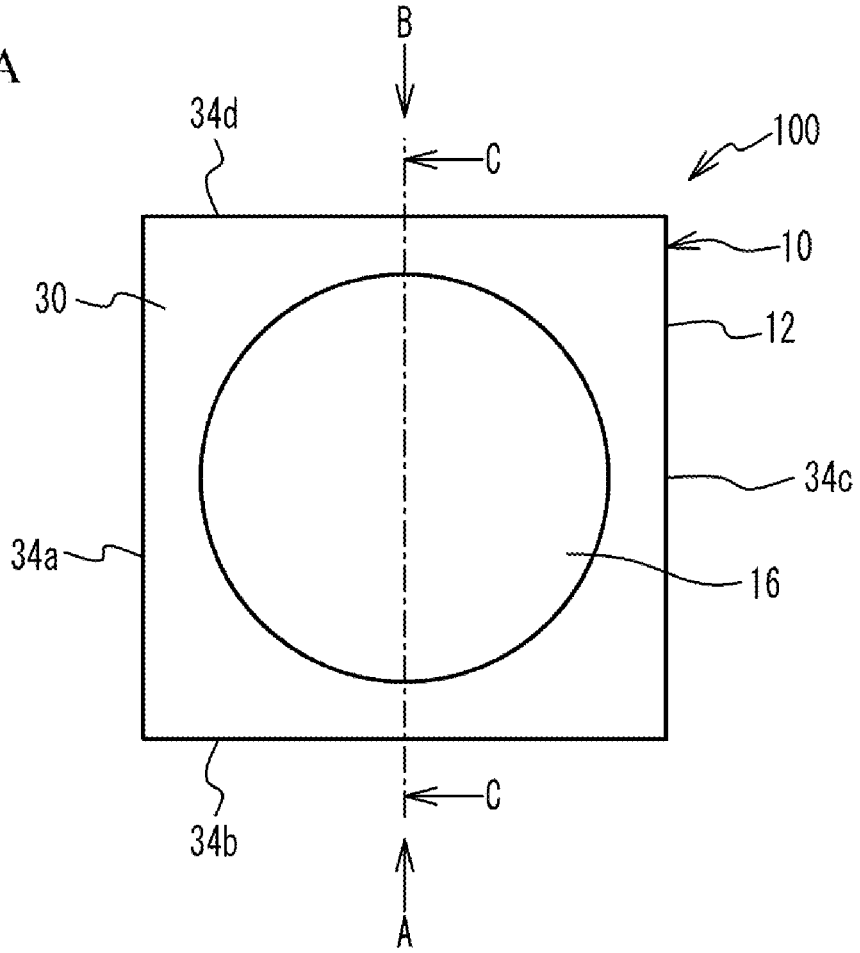
Figure 1B:
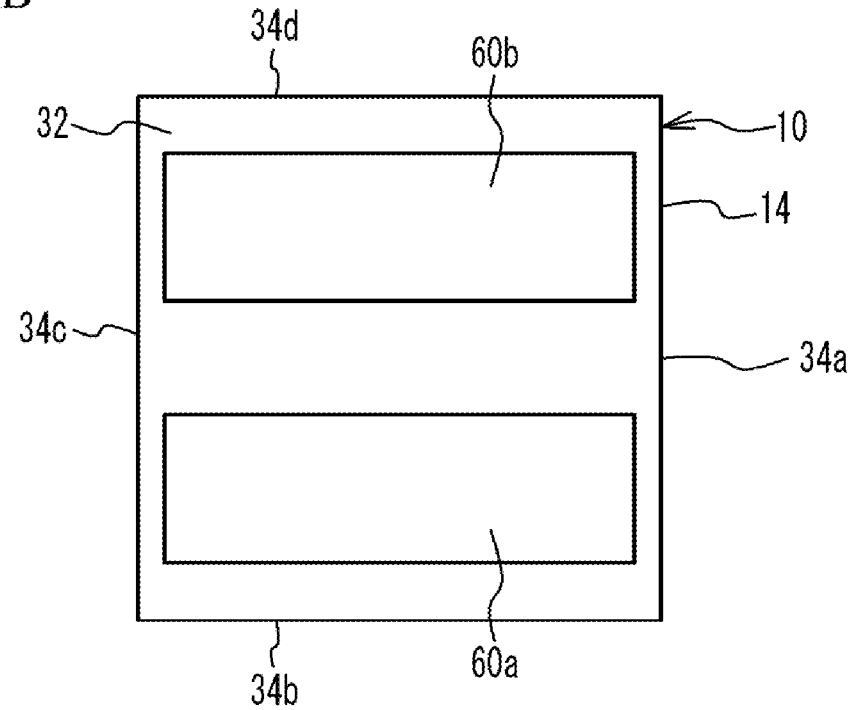
FIG. 1B is a bottom view, of the coil component pertaining to Example 1
Figure 2A:
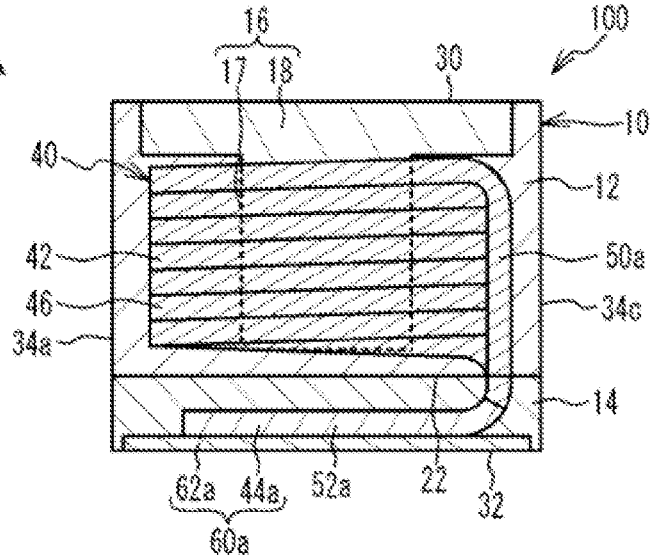
Figure 2B:
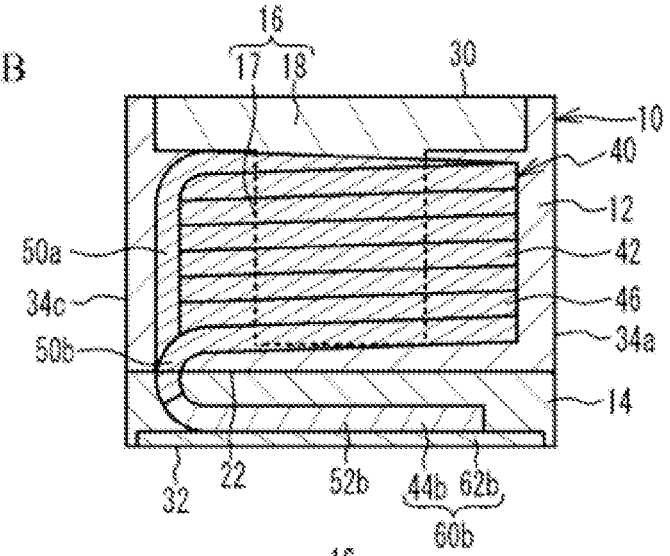
Figure 2C:
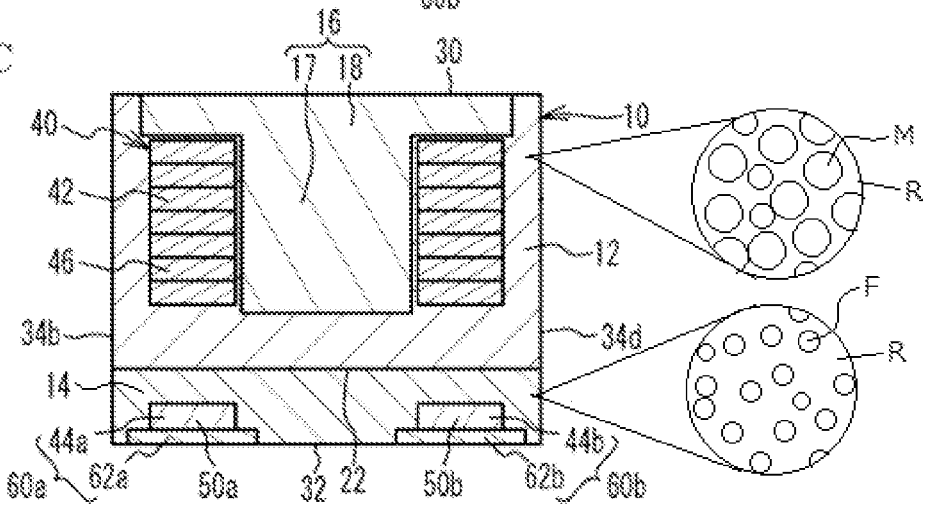
FIG. 2C is a cross-sectional view, of the coil component pertaining to Example 1.

FIG. 1A is a top view, while FIG. 1B is a bottom view, of the coil component pertaining to Example 1. FIGS. 2A and 2B are interior perspective side views, while FIG. 2C is a cross-sectional view, of the coil component pertaining to Example 1. FIG. 2A is an interior perspective side view of FIG. 1A from direction A, FIG. 2B is an interior perspective side view of FIG. 1A from direction B, and FIG. 2C is a view of cross-section C-C in FIG. 1A. It should be noted that, in FIGS. 2A and 2B (although these figures are not cross sectional views), each member is hatched for the purpose of illustrative clarity (the same shall apply hereinafter regarding interior perspective side views with hatching).

As shown in FIGS. 1A and 1B and FIGS. 2A to 2C, the coil component 100 in Example 1 comprises a substrate body 10, a coil 40, a pair of lead wires 50*a*, 50*b*, and a pair of terminal parts 60*a*, 60*b*.

The substrate body 10 is formed in such a way that it includes a resin part 12 and a resin part 14 whose resin content is higher than that of the resin part 12. The resin part 12 may include a core 16 as part thereof. The core 16 may have higher magnetic permeability than the resin part 12. The resin part 14 is integrally molded with the resin part 12, for example. In other words, the resin part 14 is directly joined to a bottom face 22 of the resin part 12 on a mounting-surface side where the substrate body is mounted on a circuit board, of the resin part 12. Joining the resin part 14 directly to the resin part 12 ensures joining strength. Also, as explained later in Example 4, the resin part 14 may also be joined directly to the top and side faces of the resin part 12 in addition to the bottom face 22 of the resin part 12, which increases the joining strength further. The resin parts 12, 14 may be prepared as separate, independent members and the resin part 14 may be joined to the bottom face 22 of the resin part 12 with adhesive, etc.; in this case, however, the joining strength of the resin parts 12, 14 will drop because they are not integrally molded. In addition, the lead wires 50*a*, 50*b* in the resin part 12, and the lead wires 50*a*, 50*b* in the resin part 14, will have to be joined either inside or outside the substrate body 10 because these parts are formed as separate members. For these reasons, joining the resin part 14 to the resin part 12 with adhesive is not a very desirable proposition. The core 16 includes an axis of winding 17 and a flange part 18 provided on one end of the axis of winding 17 in the axial direction, and is embedded in the resin part 12. It should be noted that the core 16 may be shaped as a drum core (H-core), I-core, and the like, in addition to the T-core described above. The axis of winding 17 has a columnar shape, for example, while the flange part 18 has a disk shape with thickness in the axial direction of the axis of winding 17, for example.

The resin part 12 is formed by a resin that contains magnetic grains. In one example, the resin part 12 is formed in such a way that it contains magnetic grains, and an epoxy resin, at a ratio of 80 percent by volume for the former and 20 percent by volume for the latter, and it has a thermal expansion coefficient of 20 ppm/° C. to 25 ppm/° C. It should be noted that the coefficient of thermal expansion can be confirmed by TMA (Thermomechanical Analysis) The magnetic grains include, for example, those constituted by Ni—Zn, Mn—Zn and other ferrite materials, Fe—Si—Cr, Fe—Si—Al, Fe—Si—Cr—Al and other soft magnetic alloy materials, Fe, Ni and other magnetic metal materials, amorphous magnetic metal materials, nanocrystal magnetic metal materials, and the like. If these magnetic grains are constituted by soft magnetic alloy materials, magnetic metal materials, amorphous metal materials, or nanocrystal magnetic metal materials, these grains may be given insulation treatment on their surface. For the resin, silicone resins, phenolic resins, and other thermosetting resins, as well as polyamide resins, fluororesins, and other thermoplastic resins, may also be used, for example, in addition to epoxy resins. For the resin part 12, a resin whose heat resistance is greater than the maximum allowable temperature of the coil component is selected.

The resin part 14 is formed by a resin that contains filler. In one example, the resin part 14 is formed in such a way that it contains a filler constituted by silicone oxide, and an epoxy resin, at a ratio of 60 percent by volume for the former and 40 percent by volume for the latter, and it has a thermal expansion coefficient comparable with that of the resin part 12. The filler is added to bring the thermal expansion coefficient of the resin part 14 closer to the thermal expansion coefficient of the resin part 12, for example. Examples of the filler include aluminum oxide, titanium oxide, zinc oxide, and other inorganic grains, for example, in addition to silicone oxide. Preferably the filler uses a highly insulating material. It should be noted that, while the resin part 14 may include magnetic grains as the filler, preferably it does not contain magnetic grains offering lower insulation than the resin or filler (other than magnetic grains) from the viewpoint of ensuring insulation, and more preferably it does not contain metal magnetic grains whose insulation level is particularly low. For the resin, silicone resins, phenolic resins, and other thermosetting resins, as well as polyamide resins, fluororesins, and other thermoplastic resins, may also be used, for example, in addition to epoxy resins. For the resin part 14, a resin whose heat resistance is greater than the maximum allowable temperature of the coil component is also selected. Preferably the resin that forms the resin part 14 is the same resin that forms the resin part 12, but they may also be different resins.

The core 16 is formed by a material that contains magnetic material; specifically, it is formed by a ferrite material, magnetic metal material, or resin that contains magnetic material. For example, the core 16 is formed by Ni—Zn, Mn—Zn or other ferrite material, Fe—Si—Cr, Fe—Si—Al, Fe—Si—Cr—Al or other soft magnetic alloy material, Fe, Ni or other magnetic metal material, amorphous magnetic metal material, nanocrystal magnetic metal material, or resin that contains any of the foregoing. If the core 16 is formed by soft magnetic alloy material, magnetic metal material, amorphous magnetic metal material, or nanocrystal magnetic metal material, its grains may be given insulation treatment on their surface. It should be noted that not providing the core 16 is also an option.

The substrate body 10 is shaped as a rectangular solid, for example. Also, the substrate body 10 may be a quadrilateral frustum or have other shape. The length of one side of a top face 30 and bottom face 32 of the substrate body 10 is approx. 4.0 mm, for example. The height of the substrate body 10 (length between the top face 30 and the bottom face 32) is approx. 3.0 mm, for example. The bottom face 32 is a mounting surface which will be mounted on a circuit board, while the top face 30 is the face on the opposite side of the bottom face 32. The faces that connect to the top face 30 and bottom face 32 are side faces 34*a* to 34*d*.

The coil 40 is formed by winding a conductive wire 42 which is a metal wire covered with an insulating film, and embedded in the resin part 12 of the substrate body 10. The coil 40 is embedded entirely in the resin part 12, for example, but it may also be embedded at least partially in the resin part 12. The coil 40 is not exposed to the outside of the resin part 12, for example. Both ends of the conductive wire 42 are led out from the coil 40 to become the lead wires 50*a*, 50*b*. The lead wires 50*a*, 50*b* are led out continuously from the coil 40, through the resin part 12, to the resin part 14. Because the lead wires 50*a*, 50*b* are led out continuously from the resin part 12 to the resin part 14, no lead wire joints are formed on the inside or outside of the resin parts 12, 14. This reduces the joining man-hours and also eliminates the need for taking insulation measures at the joints.

The coil 40 is formed by winding edge-wise a conductive wire 42 comprising a rectangular wire whose cross-section shape is rectangular, for example, but how it is formed is not limited to the foregoing. The coil 40 may also be formed by winding the conductive wire 42 by alpha-winding or other winding method. Also, the conductive wire 42 is not limited to a rectangular wire; for example, it may be a round wire whose cross-section shape is circular, or it may have other shape.

The conductive wire 42 has a covered part where the metal wire is covered with the insulating film, and non-covered parts where the metal wire is not covered with the insulating film. A tip area 52*a* of the lead wire 50*a*, and a tip area 52*b* of the lead wire 50*b*, represent the non-covered parts 44*a*, 44*b* where the metal wire is not covered with the insulating film but is exposed. The parts of the conductive wire 42 other than the tip areas 52*a*, 52*b* of the lead wires 50*a*, 50*b*, represent a covered part 46 where the metal wire is covered with the insulating film. Accordingly, the coil 40 is formed by winding the covered part 46 of the conductive wire 42. The material of the metal wire is copper, copper alloy, silver, palladium, and the like, for example, but other metal material may also be used. The material of the insulating film is polyester imide, polyamide, or other resin material, for example, but other insulating material may also be used.

The lead wires 50*a*, 50*b* are led out from the resin part 12 into the resin part 14. In one example, the lead wires 50*a*, 50*b* are bent in such a way that, near the bottom face 32 of the substrate body 10, they run parallel with the bottom face 32; however, bending them is not absolutely necessary. Because the lead wires 50*a*, 50*b* are bent, the height of the component as a whole can be lowered. The lead wires 50*a*, 50*b* run through the boundary between the resin parts 12, 14 at the covered part 46 where the metal wire is covered with the insulating film. Accordingly, the lead wires 50*a*, 50*b* are embedded partially in the resin part 14 at the covered part 46. The tip areas 52*a*, 52*b*, which are the non-covered parts 44*a*, 44*b*, of the lead wires 50*a*, 50*b* are embedded in the resin part 14, and in one example, they extend in parallel with the bottom face 32 of the substrate body 10 along the bottom face 32. It should be noted that "parallel" is not limited to a case of perfect parallelism between the tip areas 52*a*, 52*b* of the lead wires 50*a*, 50*b* and the bottom face 32 of the substrate body 10. For example, it also includes cases of approximate parallelism, such as a small offset from parallelism due to manufacturing error, with the tip areas 52*a*, 52*b* of the lead wires 50*a*, 50*b* tilted by 10° or less relative to the bottom face 32 of the substrate body 10.

The non-covered parts 44*a*, 44*b* of the lead wires 50*a*, 50*b* are embedded entirely in the resin part 14 and not exposed to the outside of the resin part 14, in one example. For this reason, the non-covered parts 44*a*, 44*b* of the lead wires 50*a*, 50*b* are not in contact with the resin part 12. In contact with the resin part 12 is the covered part 46 of the conductive wire 42.

The terminal part 60*a* comprises the non-covered part 44*a* of the lead wire 50*a* and a metal member 62*a* joined to the non-covered part 44*a*, and is embedded in the resin part 14, in one example. In this example, the metal member 62*a* is joined to the non-covered part 44*a* of the lead wire 50*a* inside the resin part 14. The terminal part 60*b* comprises the non-covered part 44*b* of the lead wire 50*b* and a metal member 62*b* joined to the non-covered part 44*b*, and is embedded in the resin part 14, in one example. In this example, the metal member 62*b* is joined to the non-covered part 44*b* of the lead wire 50*b* inside the resin part 14. The terminal parts 60*a*, 60*b* are connected electrically to the lead wires 50*a*, 50*b*. Because the lead wires 50*a*, 50*b* are bent near the bottom face 32 of the substrate body 10, the joining areas of the non-covered parts 44*a*, 44*b* of the lead wires 50*a*, 50*b*, and the metal members 62*a*, 62*b*, can be increased to ensure joining. Preferably the metal members 62*a*, 62*b* are formed by a material having high electrical conductivity and high mechanical rigidity, where, for example, a copper plate, copper alloy plate, or other metal plate of approx. 0.05 mm to 0.2 mm in thickness is preferred. For the joining of the metal members 62*a*, 62*b* and the non-covered parts 44*a*, 44*b* of the lead wires 50*a*, 50*b*, any generally known metal-on-metal joining method, such as solder joining, laser welding, pressure bonding, ultrasonic joining, and the like, may be used.

The metal members 62*a*, 62*b* are positioned on the opposite side of the resin part 12 with respect to the non-covered parts 44*a*, 44*b* of the lead wires 50*a*, 50*b*, and embedded in the resin part 14 in such a way that their bottom faces are exposed from the bottom face 32 of the substrate body 10. Since the non-covered parts 44*a*, 44*b* of the lead wires 50*a*, 50*b* are not in contact with the resin part 12, the metal members 62*a*, 62*b* are not in contact with the resin part 12, either. In other words, the resin part 14 is disposed between the terminal part 60*a* constituted by the non-covered part 44*a* of the lead wire 50*a* and the metal member 62*a*, and the resin part 12, while the resin part 14 is also disposed between the terminal part 60*b* constituted by the non-covered part 44*b* of the lead wire 50*b* and the metal member 62*b*, and the resin part 12. It should be noted that, so long as the bottom faces of the metal members 62*a*, 62*b* are exposed from the bottom face 32 of the substrate body 10, the terminal parts 60*a*, 60*b* may be embedded entirely in the resin part 14 of the substrate body 10, or they may be embedded partially in their thickness direction in the resin part 14. The bottom faces of the metal members 62*a*, 62*b* may be flush with the bottom face 32 of the substrate body 10, for example.

Figure 3B:
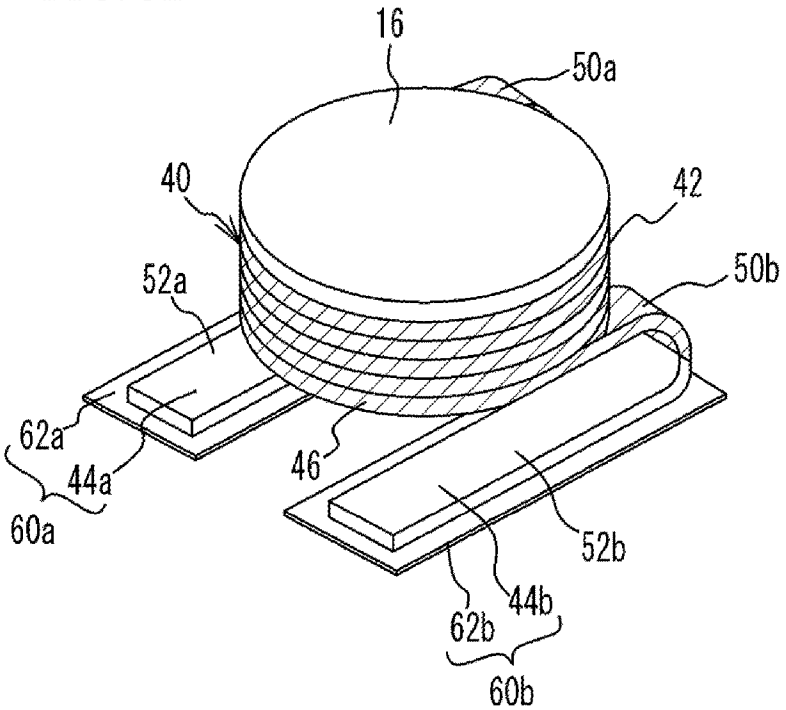
FIGS. 3A and 3B are drawings showing how the coil component pertaining to Example 1 is manufactured (First part).
Figure 3A:
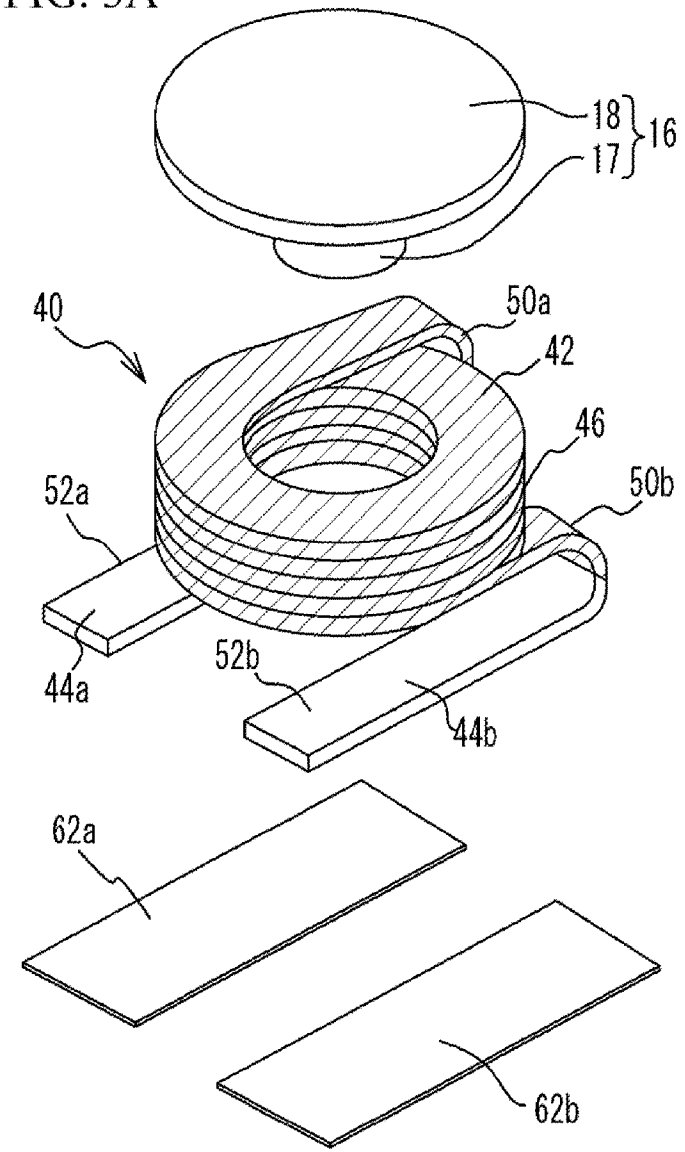

Next, how the coil component 100 in Example 1 is manufactured, is explained. FIGS. 3A to 4C are drawings showing how the coil component pertaining to Example 1 is manufactured. It should be noted that, for the purpose of illustrative clarity, the covered part 46 representing the part of the conductive wire 42 where the metal wire is covered with the insulating film is hatched in FIGS. 3A and 3B, while each member is hatched in FIGS. 4A to 4C. As shown in FIGS. 3A and 3B, first a conductive wire 42 constituted by a rectangular wire is wound edge-wise to form a coil 40, and two lead wires 50*a*, 50*b* running straight and roughly parallel to each other are led out from the coil 40 by an appropriate length. Next, the insulating film is stripped at the tip area 52*a* of the lead wire 50*a* and tip area 52*b* of the lead wire 50*b*, to produce non-covered parts 44*a*, 44*b* where the metal wire is exposed. The insulating film may be stripped by irradiating laser beam, using a cutting knife, applying a chemical reagent, and the like.

Next, a forming process to bend the lead wires 50*a*, 50*b* is performed, so that the tip areas 52*a*, 52*b* of the lead wires 50*a*, 50*b* are positioned on the same side with respect to the coil 40 and become roughly parallel to each other. Next, a metal member 62*a* is joined to the non-covered part 44*a* of the lead wire 50*a*, while a metal member 62*b* is joined to the non-covered part 44*b* of the lead wire 50*b*. The metal members 62*a*, 62*b* may be joined by, for example, solder joining, laser welding, pressure bonding, ultrasonic joining, and the like. The non-covered parts 44*a*, 44*b* of the lead wires 50*a*, 50*b* and metal members 62*a*, 62*b* joined to the non-covered parts 44*a*, 44*b* become terminal parts 60*a*, 60*b*. Next, a core 16 having an axis of winding 17 and a flange part 18 is installed in the coil 40, with the axis of winding 17 inserted into the hollow core part of the coil 40.

Figure 4A:
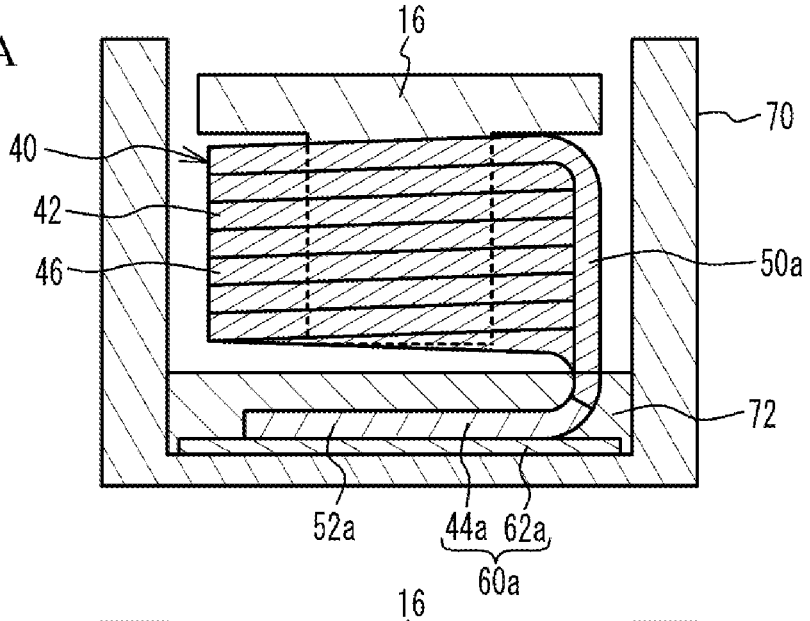
FIGS. 4A to 4C are drawings showing how the coil component pertaining to Example 1 is manufactured (Second part).

As shown in FIG. 4A, the coil 40 in which the core 16 has been installed is set in a die 70. Then, a filler-containing liquid resin for forming resin part 14 is injected into the die 70 using a dispenser, and the like. At this time, the filler-containing liquid resin is injected until the non-covered parts 44*a*, 44*b* of the lead wires 50*a*, 50*b* are completely embedded. Thereafter, the filler-containing liquid resin that has been filled in the die 70 is tentatively cured. The tentative curing may be implemented under the condition of maintaining 150° C. for 5 minutes, for example, if a thermosetting resin is used for the liquid resin for forming resin part 14. This way, a resin layer 72, where the filler-containing liquid resin for forming resin part 14 is held in shape, is formed. It should be noted that a defoaming step to remove air bubbles from the filler-containing liquid resin that has been filled in the die 70, may be performed prior to the tentative curing.

Figure 4B:
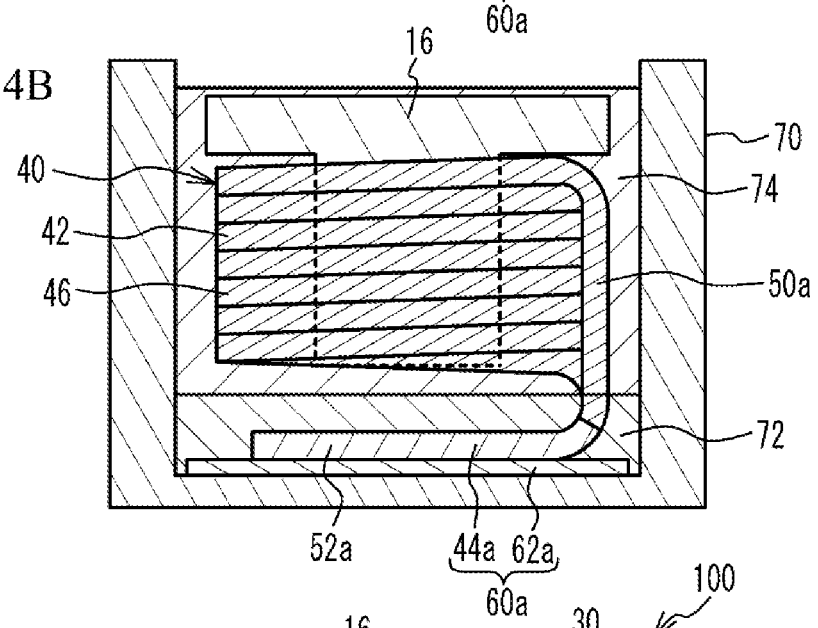

As shown in FIG. 4B, a magnetic-grain-containing liquid resin for forming resin part 12 is injected into the die 70 using a dispenser, and the like. At this time, the magnetic-grain-containing liquid resin is injected until the core 16 is completely embedded. Thereafter, the magnetic-grain-containing liquid resin that has been filled in the die 70 is tentatively cured. The tentative curing may be implemented under the condition of maintaining 150° C. for 5 minutes, for example, if a thermosetting resin is used for the magnetic-grain-containing liquid resin for forming resin part 12. This way, a resin layer 74, where the magnetic-grain-containing liquid resin that has been filled in the die 70 is held in shape, is formed.

Figure 4C:
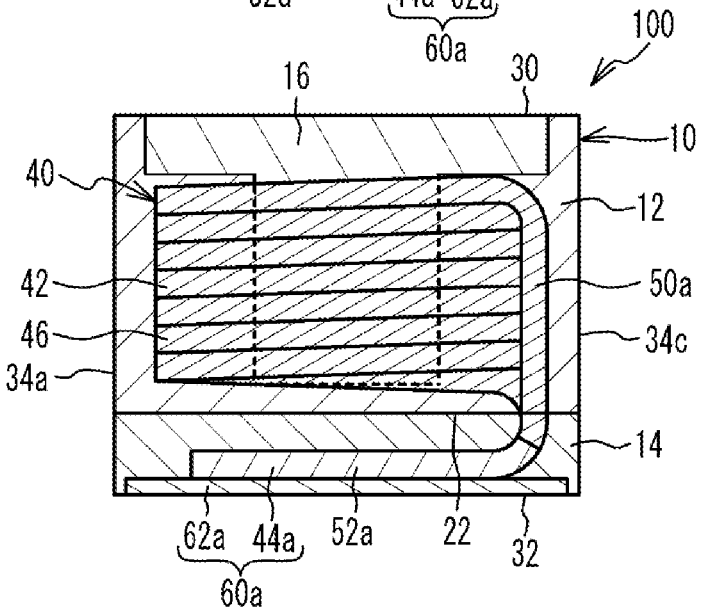

As shown in FIG. 4C, the molded body is taken out of the die 70 and, after the necessary faces are polished to remove excess areas from the resin layers 72, 74, the resin layers 72, 74 are finally cured. The final curing may be performed under conditions involving higher temperatures and longer times compared to the tentative curing, if the resin layers 72, 74 are constituted by a thermosetting resin; for example, it may be performed under the condition of maintaining 180° C. for 2 hours. This way, a coil component 100 is formed that comprises an integrally-molded substrate body 10 which, in turn, comprises a resin part 12 in which the core 16 and coil 40 have been embedded, and a resin part 14 in which the terminal parts 60*a*, 60*b*, constituted by the non-covered parts 44*a*, 44*b* of the lead wires 50*a*, 50*b* and also by the metal members 62*a*, 62*b*, have been embedded. If the resin layers 72, 74 are integrally molded, use of a filler offering high thermal conductivity can improve the thermal conduction of the cured areas. This benefits the resin curing process even for a substrate body 10 whose resin layers 72, 74 contain a filler by different additive quantities, because the overall temperature can be kept uniform with ease and the curing rates can be aligned, which leads to greater integral molding strength.

It should be noted that, if a thermoplastic resin is used for the resin layers 72, 74, the liquid resin for forming resin part 14 is heated and injected, and then cooled to some extent (cooled by 50° C., for example), to tentatively cure the liquid resin for forming resin part 14 and thereby form a resin layer 72. The magnetic-grain-containing liquid resin for forming resin part 12, which is injected next, is injected after being heated to a higher temperature than that of the liquid resin for forming resin part 14 so that the boundary areas between the resin layer 72 and the magnetic-grain-containing liquid resin for forming resin part 12 become fluid, which is then followed by cooling to achieve integral curing with the resin layer 72. If a thermoplastic resin is used, aligning the curing temperatures of the respective resin parts allows for simultaneous curing of resin, which leads to even greater integral molding strength.

It should be noted that both of the resin layers 72, 74 need not be a thermosetting resin or thermoplastic resin. A thermosetting resin may be used for one of the resin layers 72, 74, with a thermoplastic resin used for the other. Also, the resin layers 72, 74 need not be formed in this order. By setting a die opening area at a desired position such as a position on a lower side, lateral side, or upper side of the die, or the like, or by using a die that has no opening area but has an openable/closable face, the resin layers 72, 74 may be formed in a desired order.

Figure 5A:
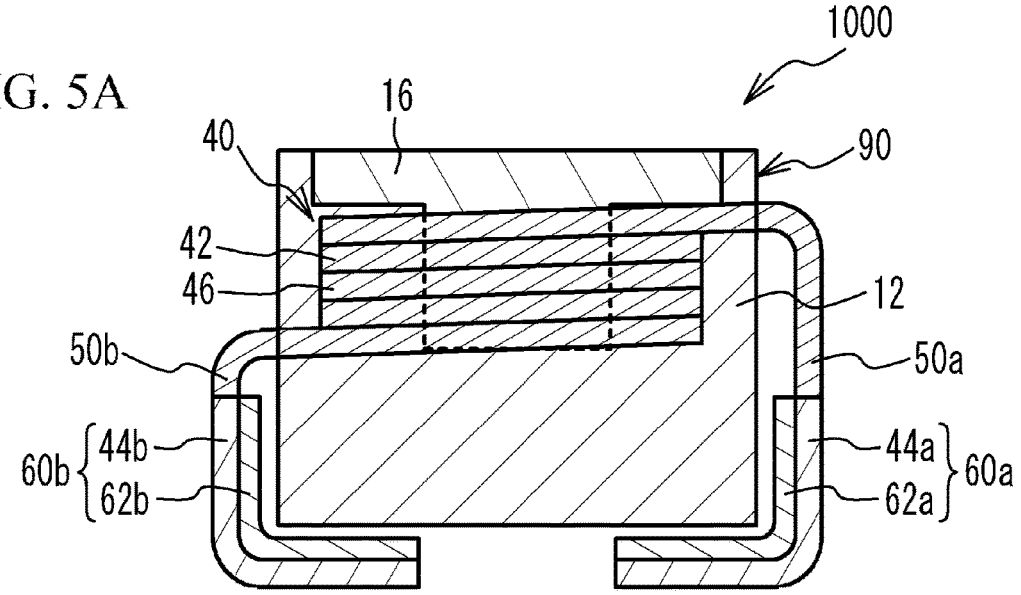
Figure 5B:
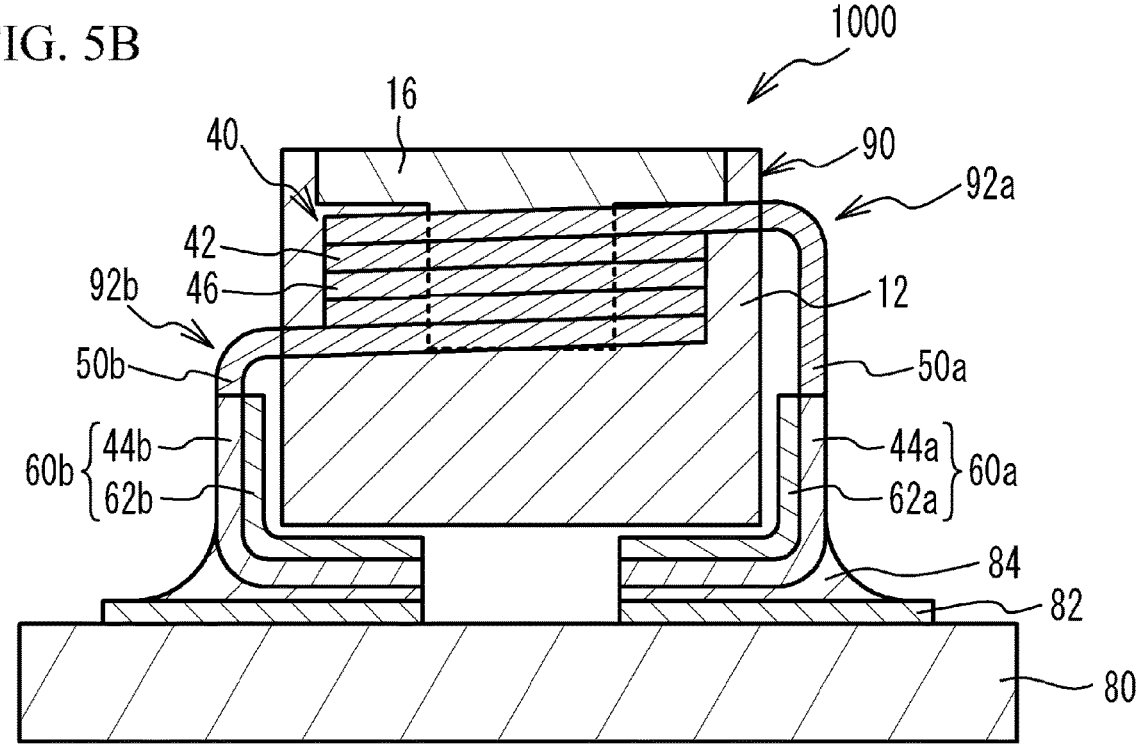
FIG. 5B is an interior perspective side view showing the coil component pertaining to Comparative Example 1 being mounted on a circuit board.

In explaining the effects of the coil component 100 in Example 1, the coil components in Comparative Examples 1 and 2 are explained. FIG. 5A is an interior perspective side view of the coil component pertaining to Comparative Example 1, while FIG. 5B is an interior perspective side view showing the coil component pertaining to Comparative Example 1 being mounted on a circuit board. It should be noted that, in FIGS. 5A and 5B, each member is hatched for the purpose of illustrative clarity. As shown in FIG. 5A, the coil component 1000 in Comparative Example 1 has a substrate body 90 formed only by the resin part 12. The lead wires 50*a*, 50*b* are led out from the side faces of the substrate body 90 to the outside of the substrate body 90. The sheet-shaped metal member 62*a*, positioned between the substrate body 90 and the lead wire 50*a*, is joined to the non-covered part 44*a* of the lead wire 50*a* to form the terminal part 60*a*. The sheet-shaped metal member 62*b*, positioned between the substrate body 90 and the lead wire 50*b*, is joined to the non-covered part 44*b* of the lead wire 50*b* to form the terminal part 60*b*. The terminal parts 60*a*, 60*b* are bent so that they extend from the side faces, onto and along the bottom face, on the outside, of the substrate body 90. Clearances are formed between the terminal parts 60*a*, 60*b* and the substrate body 90, so the terminal parts 60*a*, 60*b* are not fixed to the substrate body 90. The terminal parts 60*a*, 60*b* are not fixed to the substrate body 90, partly to eliminate the need to consider the heat resistance of the adhesive which would be used for fixing, and partly in consideration of the impact of the difference in thermal expansion coefficients between the substrate body 90 and the three layers consisting of the metal members 62*a* and 62*b* and the adhesive.

As shown in FIG. 5B, the coil component 1000 in Comparative Example 1 is mounted on the circuit board 80 as a result of the joining, to the electrode 82 on the circuit board 80 via solder 84, of the terminal parts 60*a*, 60*b* of the coil component 1000. In this case, because the terminal parts 60*a*, 60*b* are not fixed to the substrate body 90, the coil component 1000 is suspended at the regions 92*a*, 92*b* of the lead wires 50*a*, 50*b* that have been led out from the substrate body 90, serving as supporting points. This means that, if an external force applies to the coil component 1000 due to vibration, and the like, the force will concentrate and apply on/to the regions 92*a*, 92*b* of the lead wires 50*a*, 50*b* that have been led out from the substrate body 90, thereby potentially causing wire breakage or other damage to the regions 92*a*, 92*b*. If the coil component 1000 is installed in an automobile, for example, the coil component 1000 tends to vibrate and therefore large forces tend to apply to, and damage, the regions 92*a*, 92*b* of the lead wires 50*a*, 50*b*. Furthermore, as it is suspended at the regions 92*a*, 92*b* of the lead wires 50*a*, 50*b* serving as supporting points, the coil component 1000 has a certain resonance frequency against vibration. Vibration resistance tests required in automotive applications, and the like, include testing at various vibration frequencies, and these tests also cover harmonic components. Accordingly, the coil component 1000 may resonate during these vibration tests, in which case damage tends to occur because even greater forces apply to the regions 92*a*, 92*b* of the lead wires 50*a*, 50*b*.

Figure 6A:
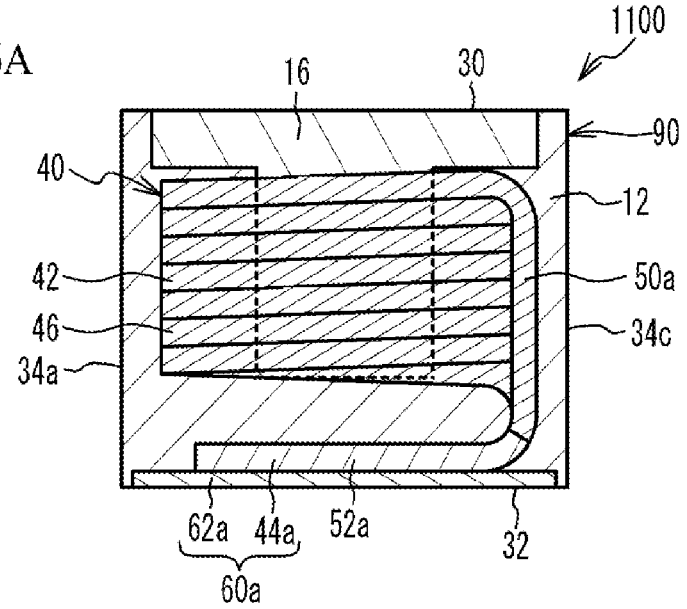
Figure 6B:
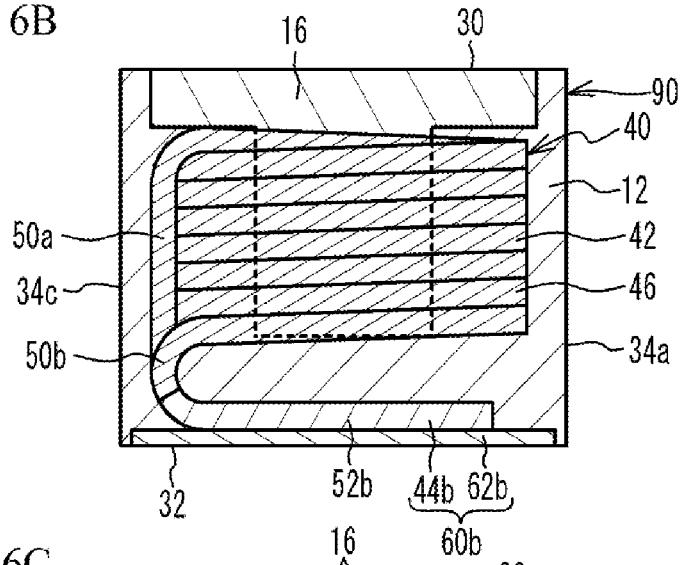
Figure 6C:
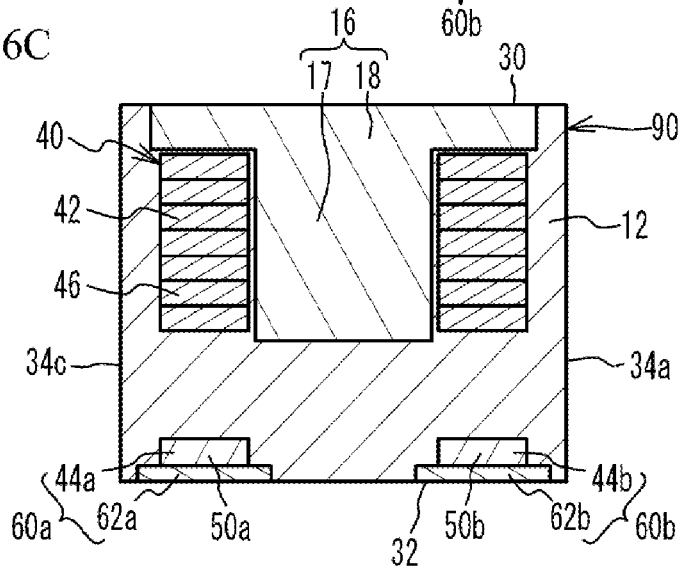
FIG. 6C is a cross-sectional view, of the coil component pertaining to Comparative Example 2.

FIGS. 6A and 6B are interior perspective side views, while FIG. 6C is a cross-sectional view, of the coil component pertaining to Comparative Example 2. It should be noted that, in FIGS. 6A to 6C, each member is hatched for the purpose of illustrative clarity. As shown in FIGS. 6A to 6C, the coil component 1100 in Comparative Example 2 also has its substrate body 90 formed only by the resin part 12, just like the coil component 1000 in Comparative Example 1. The lead wires 50*a*, 50*b* are routed inside the resin part 12. The terminal parts 60*a*, 60*b*, constituted by the non-covered parts 44*a*, 44*b* of the lead wires 50*a*, 50*b* and metal members 62*a*, 62*b* joined to the non-covered parts 44*a*, 44*b*, are embedded in the resin part 12.

In Comparative Example 2, the terminal parts 60*a*, 60*b* are embedded in the resin part 12. This means that, if external forces apply to the terminal parts 60*a*, 60*b*, the forces applied to the terminal parts 60*a*, 60*b* will be dispersed over the resin part 12, thereby preventing damage to the terminal parts 60*a*, 60*b* or to the lead wires 50*a*, 50*b*. However, increasing the content of magnetic grains in the resin part 12 for the purpose of improving the coil characteristics causes the resin content in the resin part 12 to drop. As the resin content in the resin part 12 drops, the forces applied to the terminal parts 60*a*, 60*b* can no longer be absorbed by the resin part 12, and cracks and other damage may occur to the substrate body 90 (boundaries between the terminal parts 60*a*, 60*b* and the substrate body 90, for example).

According to Example 1, on the other hand, the terminal parts 60*a*, 60*b* are embedded at least partially in the resin part 14, and the resin part 14 is also disposed between the terminal parts 60*a*, 60*b* and the resin part 12, as shown in FIGS. 2A to 2C. The resin part 14 has higher resin content than the resin part 12. This means that, if external forces apply to the terminal parts 60*a*, 60*b*, the forces applied to the terminal parts 60*a*, 60*b* are more likely to be absorbed by the resin part 14 and less likely to transmit to the resin part 12. As a result, cracks and other damage to the substrate body 10 can be prevented. In addition, the resin content in the resin part 14 can be adjusted separately from that of the resin part 12 in which the coil 40 is embedded, which allows the content of magnetic grains in the resin part 12 to be increased in consideration of the coil characteristics, while allowing the resin content in the resin part 14 to be increased. Accordingly, good coil characteristics can be achieved, while preventing damage to the substrate body 10.

The resin content in the resin part 14 is preferably 25 percent by volume or higher, or more preferably 40 percent by volume or higher, or yet more preferably 50 percent by volume or higher, from the viewpoint of allowing the forces applied to the terminal parts 60*a*, 60*b* to be absorbed easily in the resin part 14. If the resin content in the resin part 14 becomes too high, on the other hand, the difference between the thermal expansion coefficient of the resin part 12 and that of the resin part 14 will increase and cracks and other damage may occur to the substrate body 10 due to expansion and contraction caused by temperature shift. Accordingly, the resin content in the resin part 14 is preferably lower than 90 percent by volume, or more preferably lower than 80 percent by volume, or yet more preferably lower than 70 percent by volume. It should be noted here that the volume of the resin part 14 is accounted for by resin where it is not accounted for by the magnetic grains and filler.

Since the coil 40 is embedded in the resin part 12, preferably the resin part 12 contains a large amount of magnetic grains in consideration of the coil characteristics. Accordingly, the resin content in the resin part 12 is preferably lower than 25 percent by volume, or more preferably lower than 20 percent by volume, or yet more preferably lower than 15 percent by volume. Although the resin part 12 tends to suffer damage when external forces are applied, the presence of the resin part 14 disposed between the terminal parts 60*a*, 60*b* and the resin part 12 makes it harder for the external forces to transmit to the resin part 12, thus preventing damage to the resin part 12. Also, when the coil characteristics are considered, preferably the resin part 12 is formed by a resin that contains magnetic metal grains constituted by soft magnetic alloy materials, magnetic metal materials, amorphous magnetic metal materials, nanocrystal magnetic metal materials, and the like. It should be noted here that the volume of the resin part 12 is accounted for by resin where it is not accounted for by the magnetic grains.

Preferably the average grain size of the multiple filler grains fF) contained in a resin (R) in the resin part 14 the second resin part) is smaller than the average grain size of the multiple magnetic grains (M) contained in a resin (R) in the resin part 12 (the first resin part) as shown in, for example, FIG. 2C, wherein the resin content of the resin part 14 is higher than that of the resin part 12. For example, preferably the average grain size of the multiple filler grains contained in the resin part 14 is equal to or less than one-half the average grain size of the multiple magnetic grains contained in the resin part 12. For example, the average grain size of the multiple filler grains contained in the resin part 14 is preferably 5 μm or less, or more preferably 3 μm or less. When the filler content in the resin part 14 is adjusted to bring the thermal expansion coefficient of the resin part 14 closer to the thermal expansion coefficient of the resin part 12, the filler surface area that comes in contact with resin increases when the filler grain size is smaller, compared to when the grain size is larger. This allows the forces applied to the terminal parts 60*a*, 60*b* to be absorbed easily in the resin part 14, thereby preventing damage to the substrate body 10. It should be noted that the average grain size may be calculated as the average value of the diameters of the multiple magnetic grains and multiple filler grains that appear on the ground face obtained by grinding a cross-section of the resin parts 12, 14.

Through adjustment of the filler content in the resin part 14, and the like, the thermal expansion coefficient of the resin part 14 is adjusted preferably to a range of equal to or higher than 100% but no higher than 120%, or more preferably to a range of equal to or higher than 100% but no higher than 115%, or yet more preferably a range of equal to or higher than 100% but no higher than 110%, of the thermal expansion coefficient of the resin part 12. This way, occurrence of cracks and other damage to the substrate body 10 can be prevented, even when the resin parts 12, 14 expand and contract due to temperature shift.

If the thermal expansion coefficient of the resin constituting the resin parts 12, 14 is higher than the thermal expansion coefficients of the magnetic grains and filler contained in the resin parts 12, 14, preferably the thermal expansion coefficient of the filler contained in the resin part 14 is lower than the thermal expansion coefficient of the magnetic grains contained in the resin part 12. This way, the thermal expansion coefficient of the resin part 14 can be brought closer to the thermal expansion coefficient of the resin part 12, while keeping the filler content in the resin part 14 under control. In other words, the thermal expansion coefficient of the resin part 14 can be brought closer to the thermal expansion coefficient of the resin part 12, while the resin content in the resin part 14 can be increased at the same time. It should be noted that the linear expansion coefficient of the filler contained in the resin part 14 is preferably equal to or lower than 70%, or more preferably equal to or lower than 60%, or yet more preferably equal to or lower than 50%, of the linear expansion coefficient of the magnetic grains contained in the resin part 12. If the linear expansion coefficient of the magnetic grains contained in the resin part 12 is 10 ppm/° C. to 20 ppm/° C., for example, the linear expansion coefficient of the filler contained in the resin part 14 is preferably 10 ppm/° C. or lower, or more preferably 7 ppm/° C. or lower, or yet more preferably 5 ppm/° C. or lower. If silica (silicone oxide) is used as the filler, crystalline silica with a linear expansion coefficient of approx. 15 ppm/° C. may be used; however, preferably molten silica with a linear expansion coefficient of approx. 0.5 ppm/° C. is used.

Preferably the shape of the filler grains contained in the resin part 14 is roughly spherical, spherical, or amorphous. When its grains have one of these shapes, the filler is easily dispersed in the resin, which in turn makes it easy for the forces applied to the terminal parts 60*a*, 60*b* to be absorbed in the resin part 14. Also, as the filler becomes closer to spherical, manifestation of anisotropy becomes less likely and therefore stress concentration also becomes less likely, and as a result, the forces applied to the terminal parts 60*a*, 60*b* are absorbed easily in the resin part 14. Furthermore, distortion becomes less likely as the filler becomes closer to spherical, even when the resin part 14 expands thermally.

As shown in FIGS. 2A to 2C, preferably the surfaces of the terminal parts 60*a*, 60*b* are roughly flush with the surface of the resin part 14. Since this increases the area of contact between the terminal parts 60*a*, 60*b* and the resin part 14, the forces applied to the terminal parts 60*a*, 60*b* can be dispersed effectively in the resin part 14. It should be noted that "roughly flush" is not limited to when the surfaces of the terminal parts 60*a*, 60*b* are completely flush with the surface of the resin part 14; instead, it also includes when there is a step near manufacturing error (step of approx. 30 μm or less, for example).

As shown in FIGS. 2A to 2C, preferably the lead wires 50*a*, 50*b* penetrate through the boundary between the resin parts 12, 14 at the covered part 46 being covered with the insulating film. This way, reliability can be improved compared to when the lead wires 50*a*, 50*b* are led out to the outside of the substrate body 10.

As shown in FIGS. 4A to 4C, preferably the substrate body 10 is formed by integrally molding the resin parts 12, 14. This way, the joining strength between the resin parts 12, 14 can be increased. This means that, even when external forces apply to the terminal parts 60*a*, 60*b*, they are prevented from peeling at the interfaces with the resin parts 12, 14. From the viewpoint of increasing the joining strength between the resin parts 12, 14, preferably the resin that forms the resin part 12 is the same resin material as the resin that forms the resin part 14.

As shown in FIGS. 2A and 2B, preferably the lead wire 50*a* is led out from the end-of-winding position of the coil 40 toward the bottom face 32 of the substrate body 10 in a manner extending roughly perpendicular to the bottom face 32 of the substrate body 10. This allows the coil component 100 to be made smaller and also its electrical resistance to be kept low because the length of the lead wire 50*a* can be shortened. It should be noted that, if the lead wire 50*b* is long, preferably it is led out from the end-of-winding position of the coil 40 toward the bottom face 32 of the substrate body 10 in a manner extending roughly perpendicular to the bottom face 32 of the substrate body 10, just like the lead wire 50*a*.

Figure 7A:
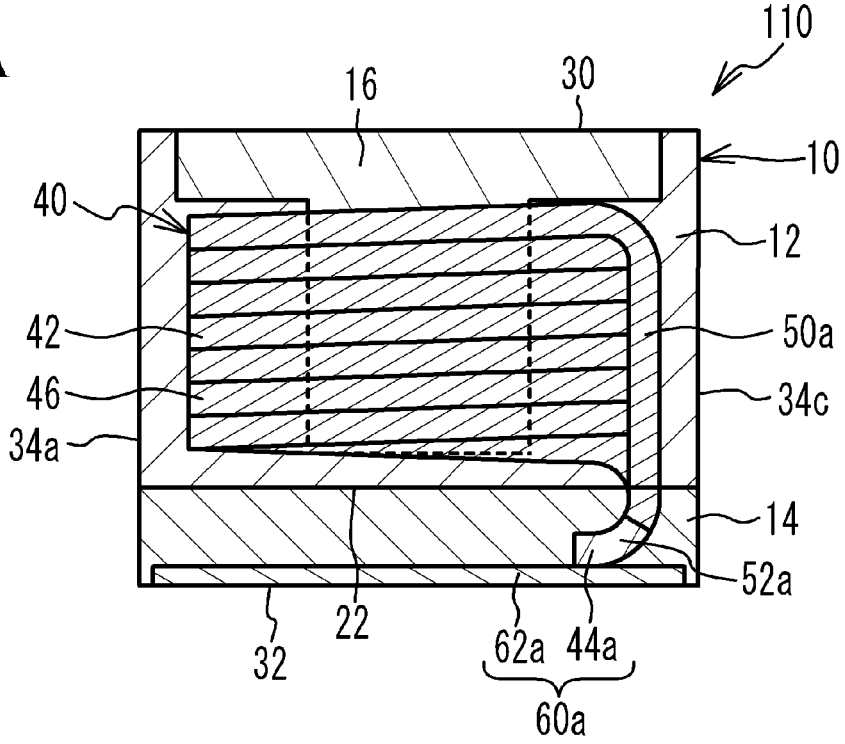
FIGS. 7A and 7B are interior perspective side views of the coil component pertaining to Variation Example 1 of Example 1.
Figure 7B:
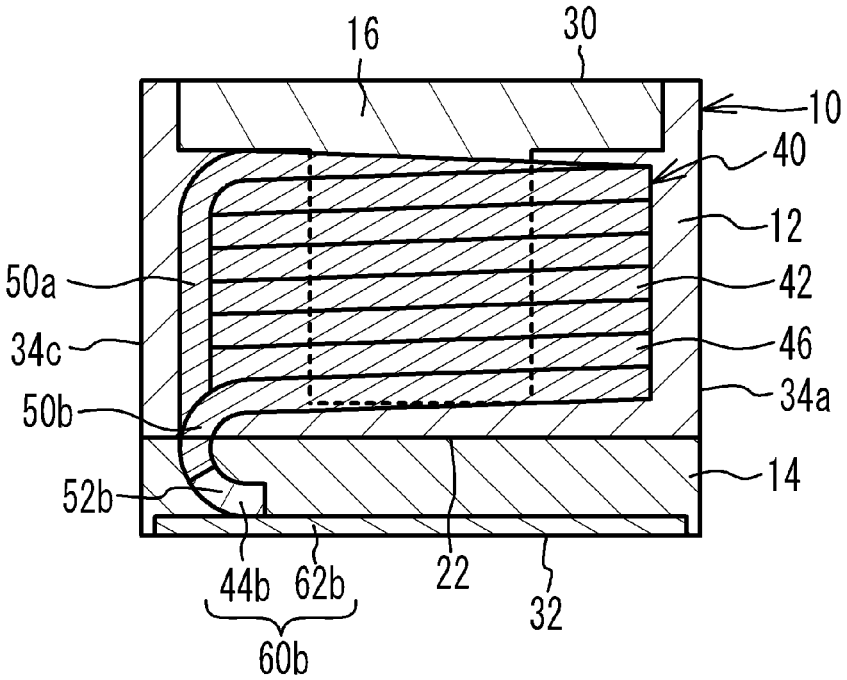

FIGS. 7A and 7B are interior perspective side views of the coil component pertaining to Variation Example 1 of Example 1. It should be noted that, in FIGS. 7A and 7B, each member is hatched for the purpose of illustrative clarity. As shown in FIGS. 7A and 7B, the coil component 110 in Variation Example 1 of Example 1 is such that the tip areas 52*a*, 52*b*, representing the non-covered parts 44*a*, 44*b*, of the lead wires 50*a*, 50*b* do not extend along the bottom face 32 of the substrate body 10. The remaining constitutions are the same as those in Example 1 and therefore not explained.

The tip areas 52*a*, 52*b*, representing the non-covered parts 44*a*, 44*b*, of the lead wires 50*a*, 50*b* may be joined to the metal members 62*a*, 62*b* by extending along the bottom face 32 of the substrate body 10, as in Example 1, or they may be joined to the metal members 62*a*, 62*b* without extending along the bottom face 32 of the substrate body 10, as in Variation Example 1 of Example 1.

Example 2

Figure 8A:
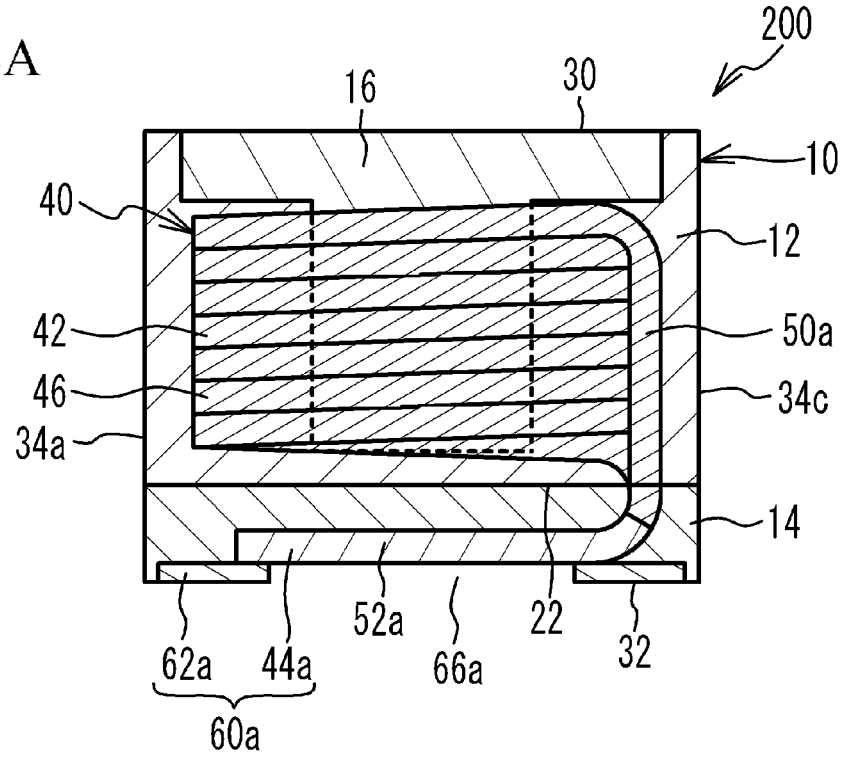
FIGS. 8A and 8B are interior perspective side views of the coil component pertaining to Example 2.
Figure 8B:
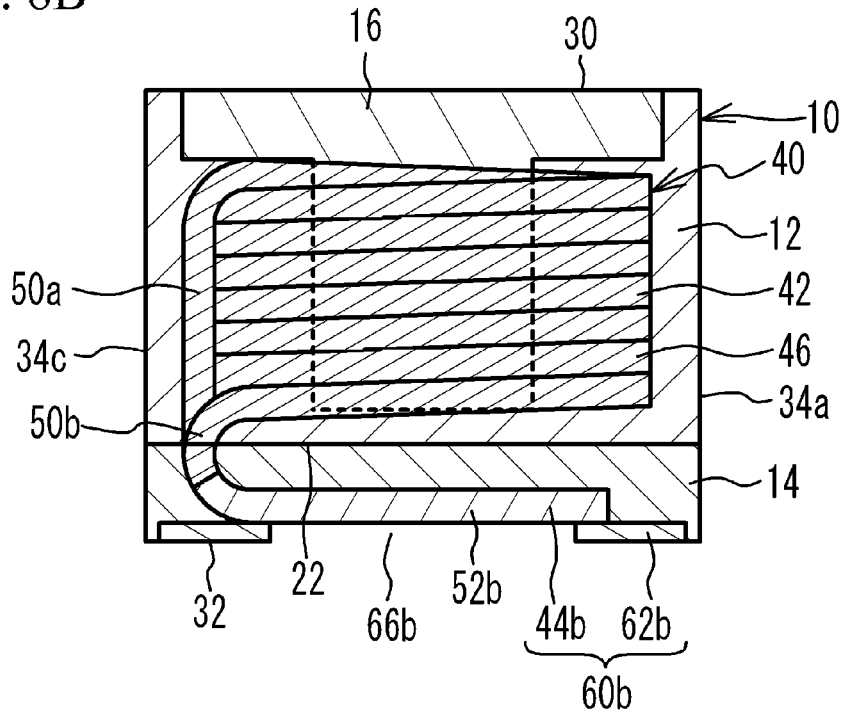

FIGS. 8A and 8B are interior perspective side views of the coil component pertaining to Example 2. It should be noted that, in FIGS. 8A and 8B, each member is hatched for the purpose of illustrative clarity. As shown in FIGS. 8A and 8B, the coil component 200 in Example 2 is such that its metal member 62*a* has an opening 66*a* at a position overlapping the tip area 52*a*, which represents the non-covered part 44*a*, of the lead wire 50*a* in the direction aligned with the bottom face 32 of the substrate body 10 (perpendicular to lead wire 50*a*, for example). In the opening 66*a*, the non-covered part 44*a* of the lead wire 50*a* is exposed. The metal member 62*b* has an opening 66*b* at a position overlapping the tip area 52*b*, representing the non-covered part 44*b*, of the lead wire 50*b* in the direction aligned with the bottom face 32 of the substrate body 10 (perpendicular to lead wire 50*b*, for example). In the opening 66*b*, the non-covered part 44*b* of the lead wire 50*b* is exposed. The remaining constitutions are the same as those in Example 1 and therefore not explained.

According to Example 2, the metal members 62*a*, 62*b* have the openings 66*a*, 66*b* at positions overlapping the non-covered parts 44*a*, 44*b* of the lead wires 50*a*, 50*b*. This means that, when the coil component 200 is mounted on a circuit board using solder, the mounting solder is directly joined to the lead wires 50*a*, 50*b*, and consequently the reliability of connection between the lead wires 50*a*, 50*b* and the circuit board can be improved.

Example 3

Figure 9A:
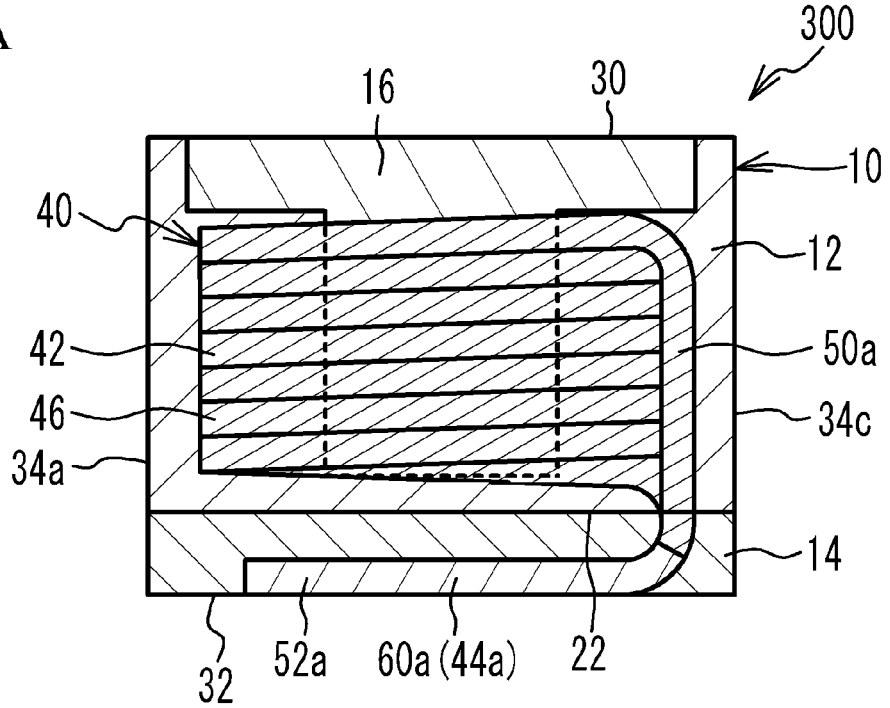
FIGS. 9A and 9B are interior perspective side views of the coil component pertaining to Example 3.
Figure 9B:
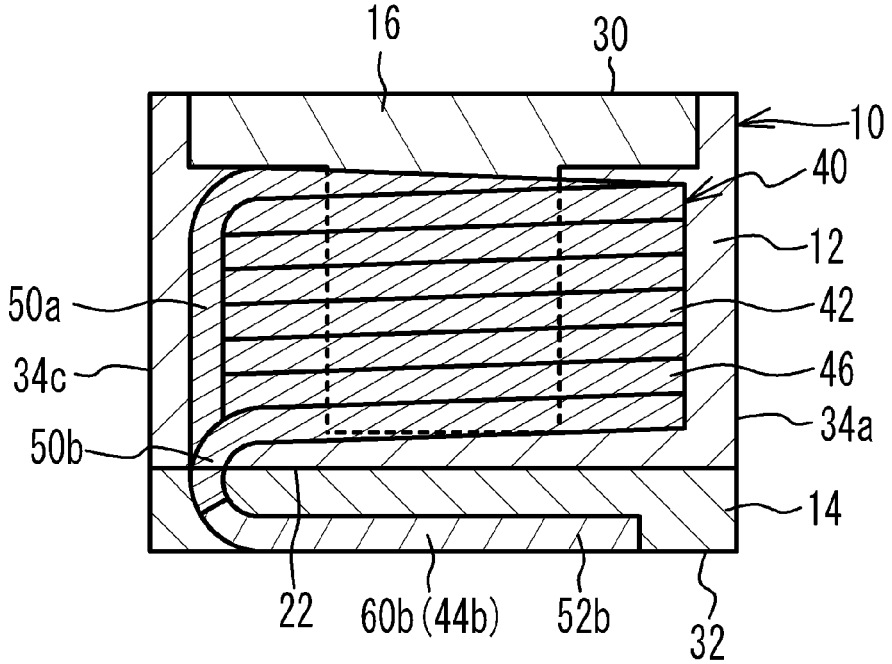

FIGS. 9A and 9B are interior perspective side views of the coil component pertaining to Example 3. It should be noted that, in FIGS. 9A and 9B, each member is hatched for the purpose of illustrative clarity. As shown in FIGS. 9A and 9B, the coil component 300 in Example 3 is such that the metal members 62*a*, 62*b* are not provided and the terminal parts 60*a*, 60*b* are constituted by the non-covered parts 44*a*, 44*b* of the lead wires 50*a*, 50*b*. Because the tip areas 52*a*, 52*b* of the lead wires 50*a*, 50*b* are bent at the bottom face 32 of the substrate body 10, the terminal parts 60*a*, 60*b* can be constituted by the tip areas 52*a*, 52*b*, representing the non-covered parts 44*a*, 44*b*, of the lead wires 50*a*, 50*b*.

The non-covered parts 44*a*, 44*b* of the lead wires 50*a*, 50*b* are embedded in the resin part 14, and the resin part 14 is disposed between them and the resin part 12. The non-covered parts 44*a*, 44*b* of the lead wires 50*a*, 50*b* are embedded in the resin part 14 in such a way that their faces on the bottom face 32 side of the substrate body 10 are exposed from the bottom face 32 of the substrate body 10. In other words, areas of the non-covered parts 44*a*, 44*b*, except for those that function as the terminal faces, are embedded entirely in the resin part 14 and not exposed to the outside of the resin part 14. It should be noted that, so long as their faces on the bottom face 32 side of the substrate body 10 are exposed from the bottom face 32 of the substrate body 10, the non-covered parts 44*a*, 44*b* may be embedded entirely, except for the faces on the bottom face 32 side of the substrate body 10, in the resin part 14, or they may be embedded partially in their thickness direction in the resin part 14. The faces of the non-covered parts 44*a*, 44*b* on the bottom face 32 side of the substrate body 10 may be flush with the bottom face 32 of the substrate body 10, for example. The remaining constitutions are the same as those in Example 1 and therefore not explained.

With the coil component 300 pertaining to Example 3, the lead wires 50*a*, 50*b* are bent into the positions of terminal parts 60*a*, 60*b* during the forming process for bending the lead wires 50*a*, 50*b* as illustrated in FIGS. 3A and 3B of Example 1. The subsequent forming steps may be implemented in the same manners as the steps explained using FIGS. 4A to 4C of Example 1.

As in Example 3, the terminal parts 60*a*, 60*b* may be constituted by the non-covered parts 44*a*, 44*b* of the lead wires 50*a*, 50*b*. In this case, when the coil component 300 is mounted on a circuit board using solder, the mounting solder is directly joined to the lead wires 50*a*, 50*b*, and consequently the reliability of connection between the lead wires 50*a*, 50*b* and the circuit board can be improved.

Example 4

Figure 10A:
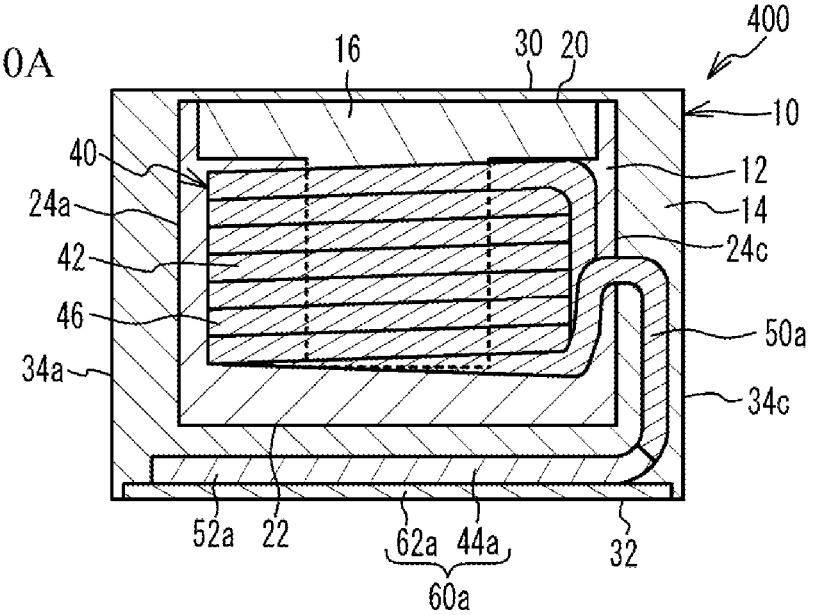
Figure 10B:
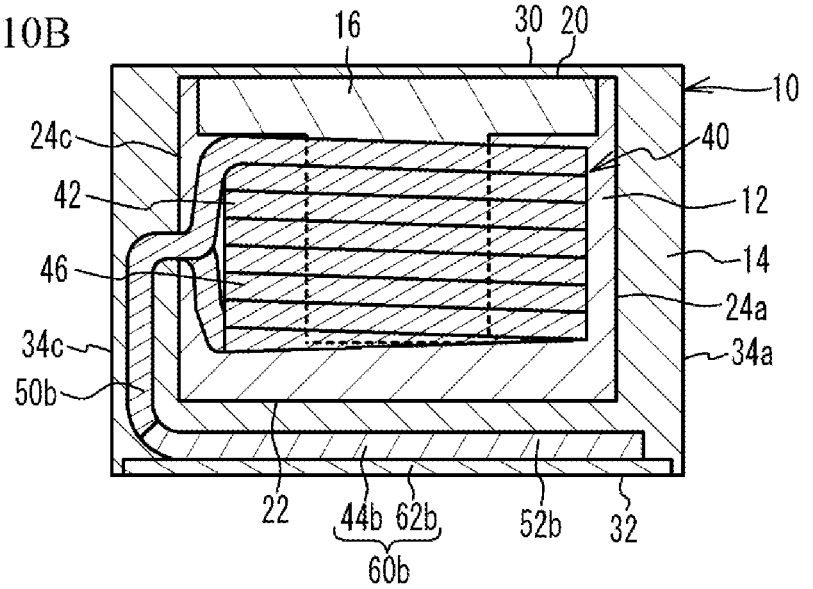
Figure 10C:
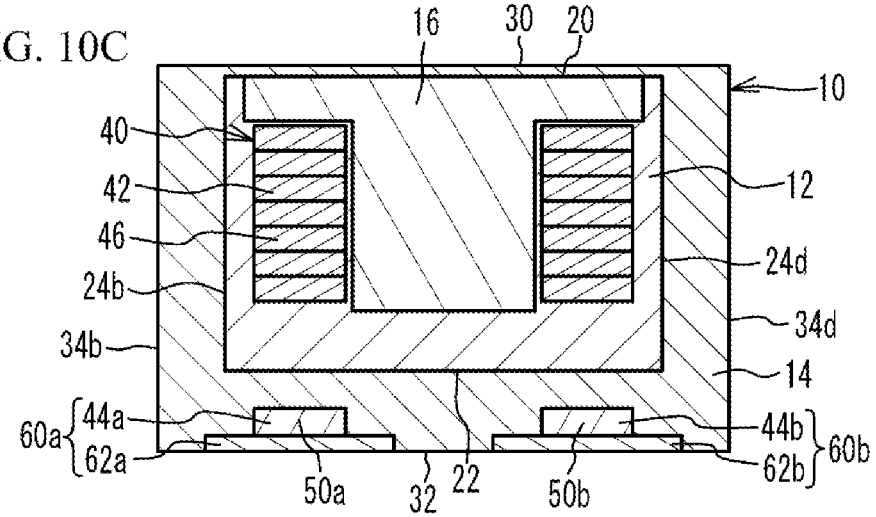
FIG. 10C is a cross-sectional view, of the coil component pertaining to Example 4.

FIGS. 10A and 10B are interior perspective side views, while FIG. 10C is a cross-sectional view, of the coil component pertaining to Example 4. It should be noted that, in FIGS. 10A and 10B, each member is hatched for the purpose of illustrative clarity. As shown in FIGS. 10A to 10C, the coil component 400 in Example 4 is such that its resin part 14 is joined to all faces of the resin part 12 including the top face 20, bottom face 22, and side faces 24*a* to 24*d*. As for the positions at which the lead wires 50*a*, 50*b* are led out from the resin part 12, the lead-out can occur at any desired position so long as it is on a face to which the resin part 14 is joined; in Example 4, the lead wires 50*a*, 50*b* are led out to the resin part 14 from the side face 24*c* of the resin part 12. The remaining constitutions are the same as those in Example 1 and therefore not explained. It should be noted that, while the terminal parts 60*a*, 60*b* in Example 4 are constitutionally identical to the terminal parts 60*a*, 60*b* in Example 1, they may be constitutionally identical to the terminal parts 60*a*, 60*b* in Example 2 or 3.

Figure 11B:
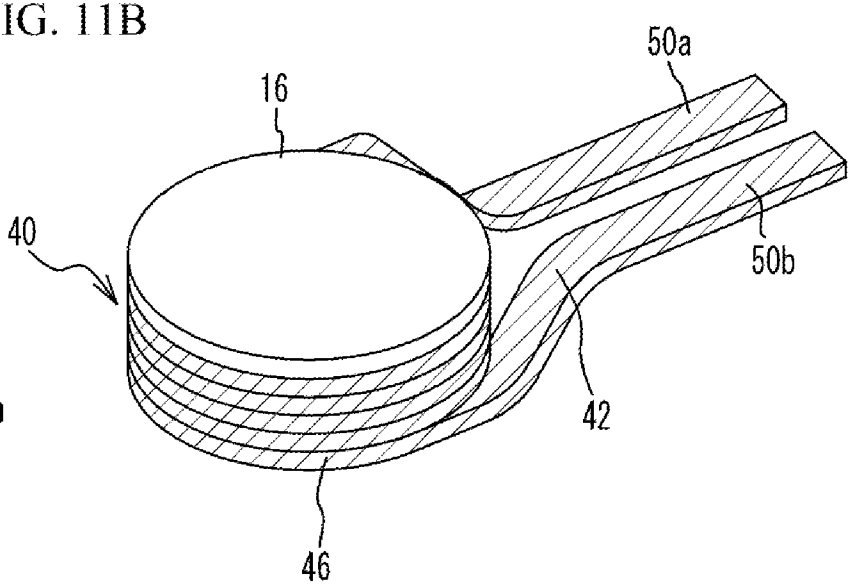
FIGS. 11A and 11B are drawings showing how the coil component pertaining to Example 4 is manufactured (First part).
Figure 11A:
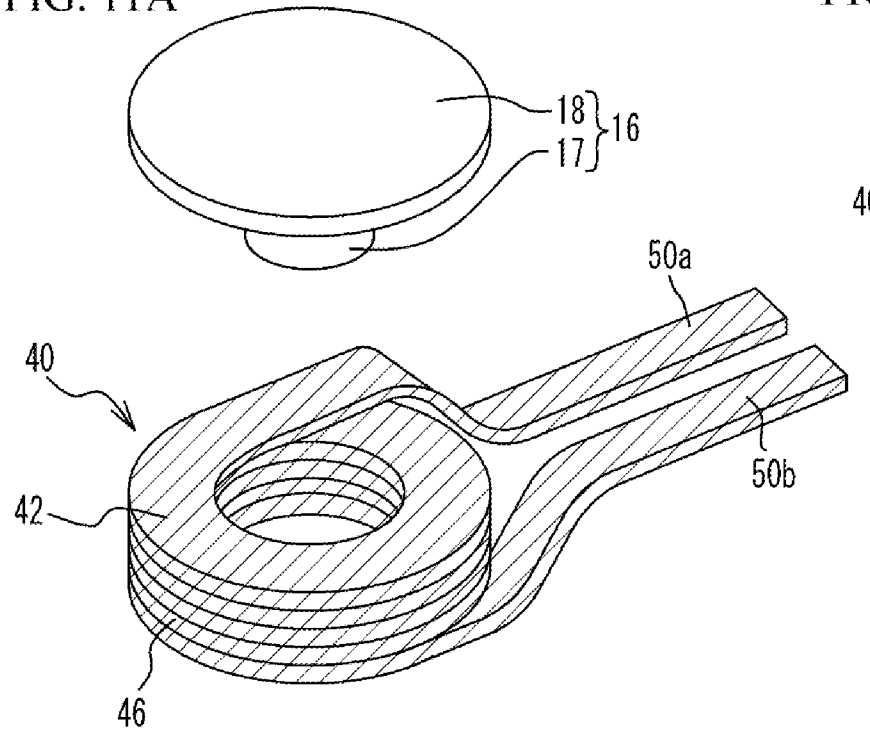

FIGS. 11A to 13B are drawings showing how the coil component pertaining to Example 4 is manufactured. It should be noted that, for the purpose of illustrative clarity, the covered part 46 of the conductive wire 42 where the metal wire is covered with the insulating film is hatched in FIGS. 11A and 11B, while each member is hatched in FIGS. 12A to 13B. As shown in FIGS. 11A and 11B, a conductive wire 42 constituted by a rectangular wire is wound edgewise to form a coil 40, and two lead wires 50*a*, 50*b* running straight and roughly parallel to each other are led out from the coil 40 by an appropriate length. Next, a forming process is performed where the lead wires 50*a*, 50*b* are bent. Next, a core 16 having an axis of winding 17 and a flange part 18 is installed in the coil 40, with the axis of winding 17 inserted into the hollow core part of the coil 40.

Figure 12A:
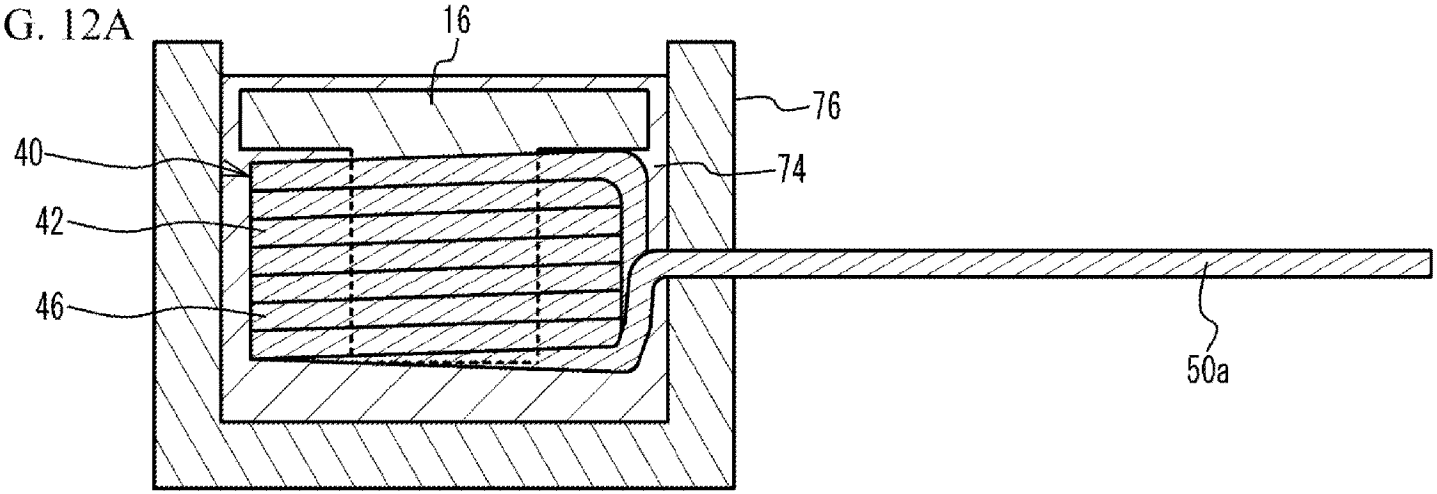
FIGS. 12A and 12B are drawings showing how the coil component pertaining to Example 4 is manufactured (Second part).

As shown in FIG. 12A, the coil 40 in which the core 16 has been installed is set in a die 76. Then, a magnetic-grain-containing liquid resin for forming resin part 12 is injected into the die 76 using a dispenser, and the like. At this time, the magnetic-grain-containing liquid resin is injected until the core 16 is completely embedded. Thereafter, the magnetic-grain-containing liquid resin that has been filled in the die 76 is tentatively cured. The tentative curing may be implemented under the condition of maintaining 150° C. for 5 minutes, for example. This way, a resin layer 74, where the magnetic-grain-containing liquid resin that has been filled in the die 76 is held in shape, is formed.

Figure 12B:
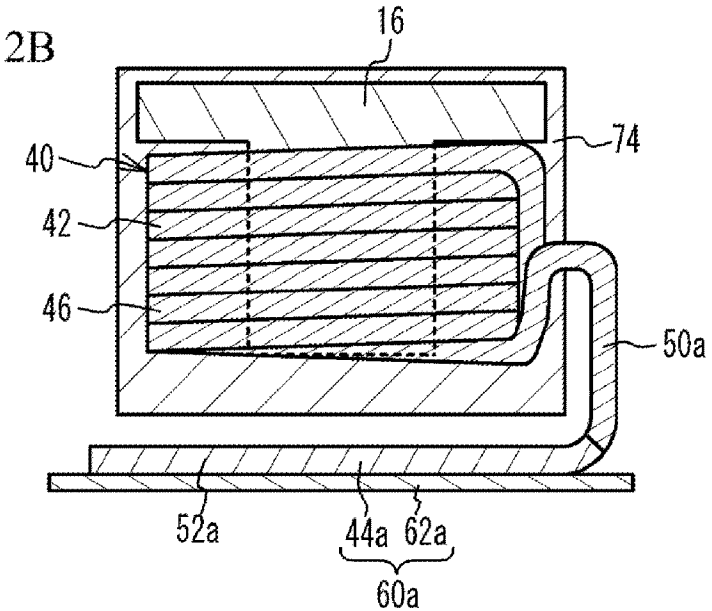

As shown in FIG. 12B, the coil 40 covered with the resin layer 74 is taken out of the die 76, after which the insulating film is stripped at the tip areas 52*a*, 52*b* of the lead wires 50*a*, 50*b* to produce non-covered parts 44*a*, 44*b* where the metal wire is exposed. Next, a forming process is performed where the lead wires 50*a*, 50*b* are bent, after which metal members 62*a*, 62*b* are joined to the tip areas 52*a*, 52*b*, representing the non-covered parts 44*a*, 44*b*, of the lead wires 50*a*, 50*b*. The non-covered parts 44*a*, 44*b* of the lead wires 50*a*, 50*b* and metal members 62*a*, 62*b* joined to the non-covered parts 44*a*, 44*b* become terminal parts 60*a*, 60*b*.

Figure 13A:
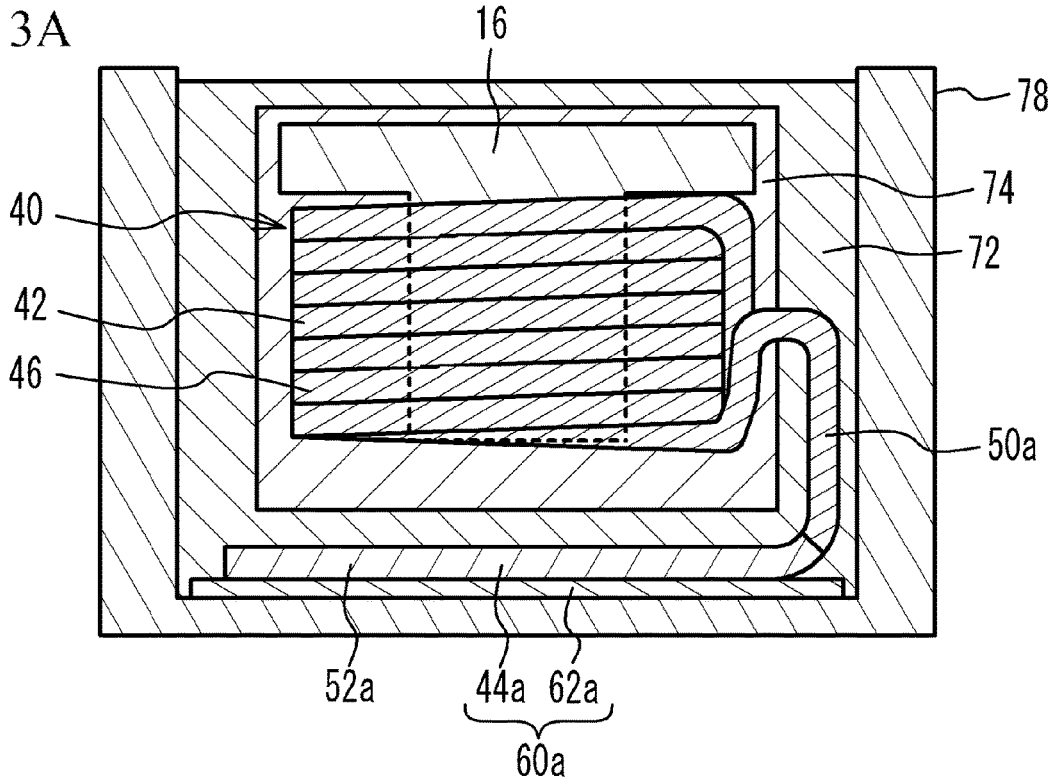
FIGS. 13A and 13B are drawings showing how the coil component pertaining to Example 4 is manufactured (Third part).

As shown in FIG. 13A, the coil 40 having the metal members 62*a*, 62*b* joined to the non-covered parts 44*a*, 44*b* of the lead wires 50*a*, 50*b* is set in a die 78. Then, a filler-containing liquid resin for forming resin part 14 is injected into the die 78 using a dispenser, and the like. At this time, the filler-containing liquid resin is injected until the resin layer 74 is embedded. Thereafter, the filler-containing liquid resin that has been filled in the die 78 is tentatively cured. The tentative curing may be implemented under the condition of maintaining 150° C. for 5 minutes, for example. This way, a resin layer 72, where the filler-containing liquid resin that has been filled in the die 78 is held in shape, is formed.

Figure 13B:
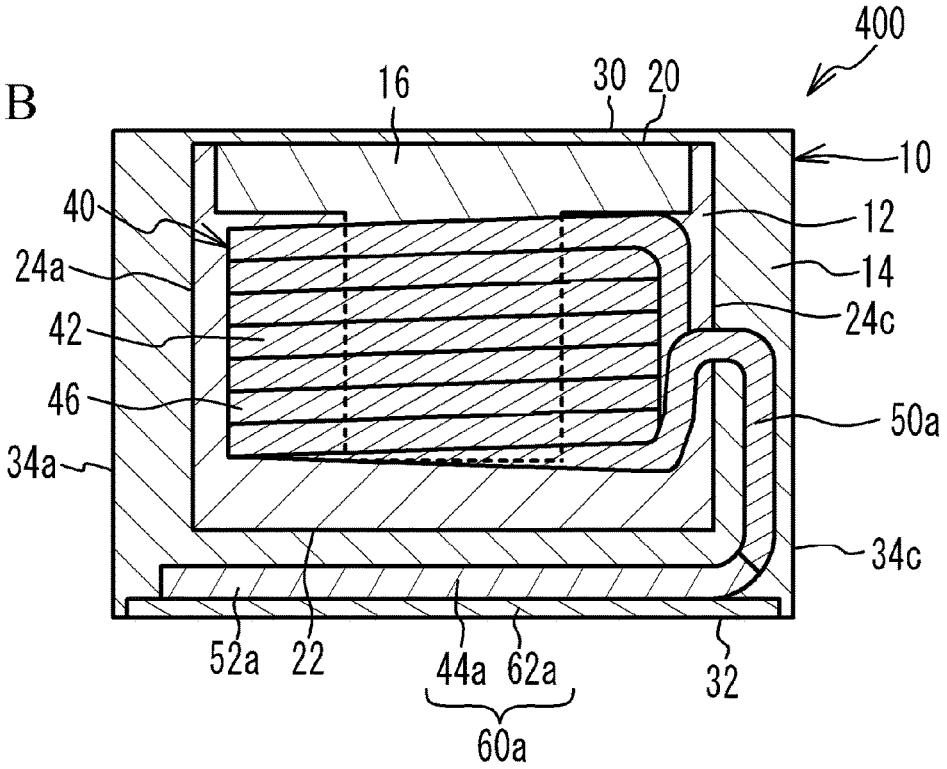

As shown in FIG. 13B, the molded body is taken out of the die 78, after which the resin layers 72, 74 are finally cured. The final curing may be performed under conditions involving higher temperatures and longer times compared to the tentative curing; for example, it may be performed under the condition of maintaining 180° C. for 2 hours. This way, a coil component 400 is formed that comprises an integrally-molded substrate body 10 which, in turn, comprises a resin part 12 in which the core 16 and coil 40 have been embedded, and a resin part 14 in which the terminal parts 60*a*, 60*b* constituted by the non-covered parts 44*a*, 44*b* of the lead wires 50*a*, 50*b* and also by the metal members 62*a*, 62*b* have been embedded. It should be noted that, while the manufacturing method described here is a manufacturing method using a thermosetting resin, a thermoplastic resin may also be used in Example 4 according to a manufacturing method similar to the one in Example 1.

According to Example 4, the resin part 14 is joined to the top face 20, bottom face 22, and side faces 24*a* to 24*c* of the resin part 12, as shown in FIGS. 10A to 10C. As a result, the joining area of the resin parts 12, 14 becomes larger and their joining strength can be increased. It should be noted that, because the resin part 12 is covered with the resin part 14 in its entirety, forces applied to the coil component 400 can be absorbed by the resin part 14, regardless of the directions from which the forces are applied, and damage to the substrate body 10 can be prevented as a result. It should be noted that, although most preferably the resin part 14 is joined to all of the top face 20, bottom face 22, and side faces 24*a* to 24*c* of the resin part 12 from the viewpoint of joining strength and damage prevention, it may be joined to at least two faces, or to the bottom face 22, and side faces 24*a* to 24*c*.

Figure 14:
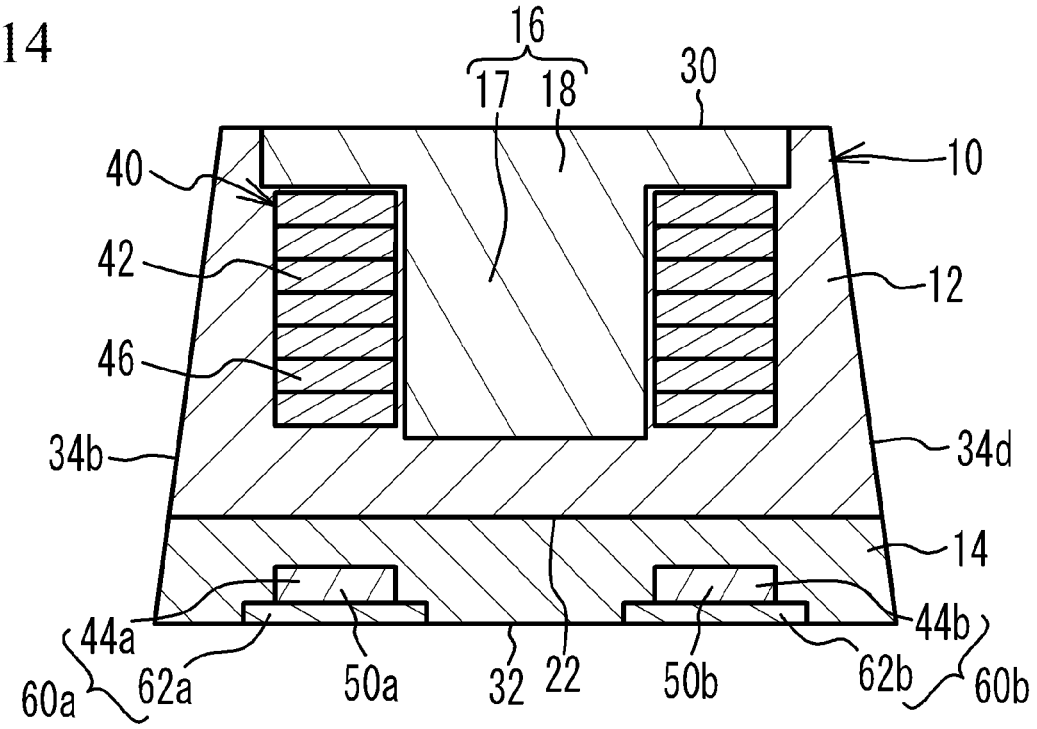
FIG. 14 is a cross-sectional view showing a substrate body whose side faces are tapered

It should be noted that, while the lead wires 50*a*, 50*b* are routed inside the substrate body 10 in Examples 1 to 4, they may be routed outside the substrate body 10. Also, the side faces of the substrate body 10 are not limited to being orthogonal, and they may be tapered in a manner expanding from the top face 30 toward the bottom face 32. FIG. 14 is a cross-sectional view showing a substrate body 10 whose side faces are tapered. Tapering enhances mechanical strength by reducing breakage that could otherwise be caused by the side faces of adjacent coil components 100 contacting each other. Also, tapering makes it easier, when a die having an opening area on the wider side of taper or die that permits opening/closing of the wider side of taper is used, to remove the molded body from the die 70.

Example 5

Figure 15A:
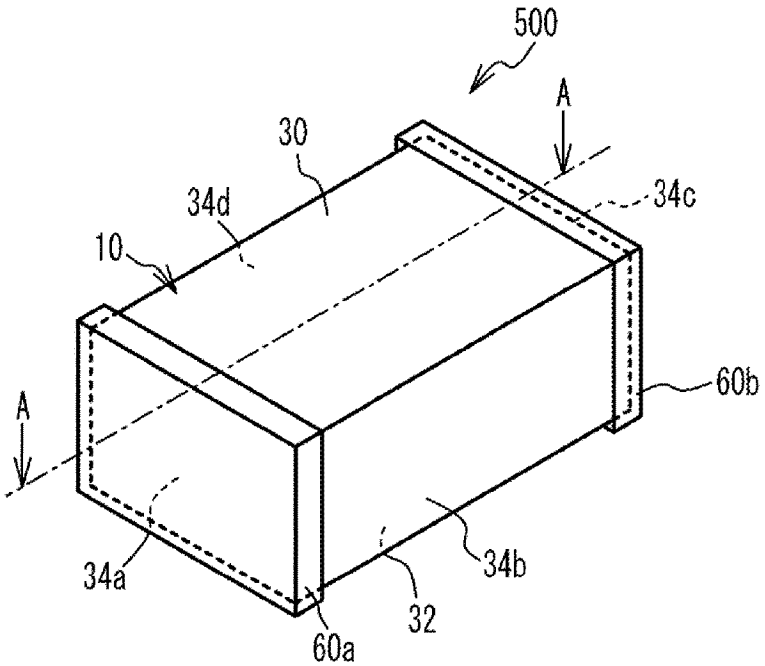
Figure 15B:
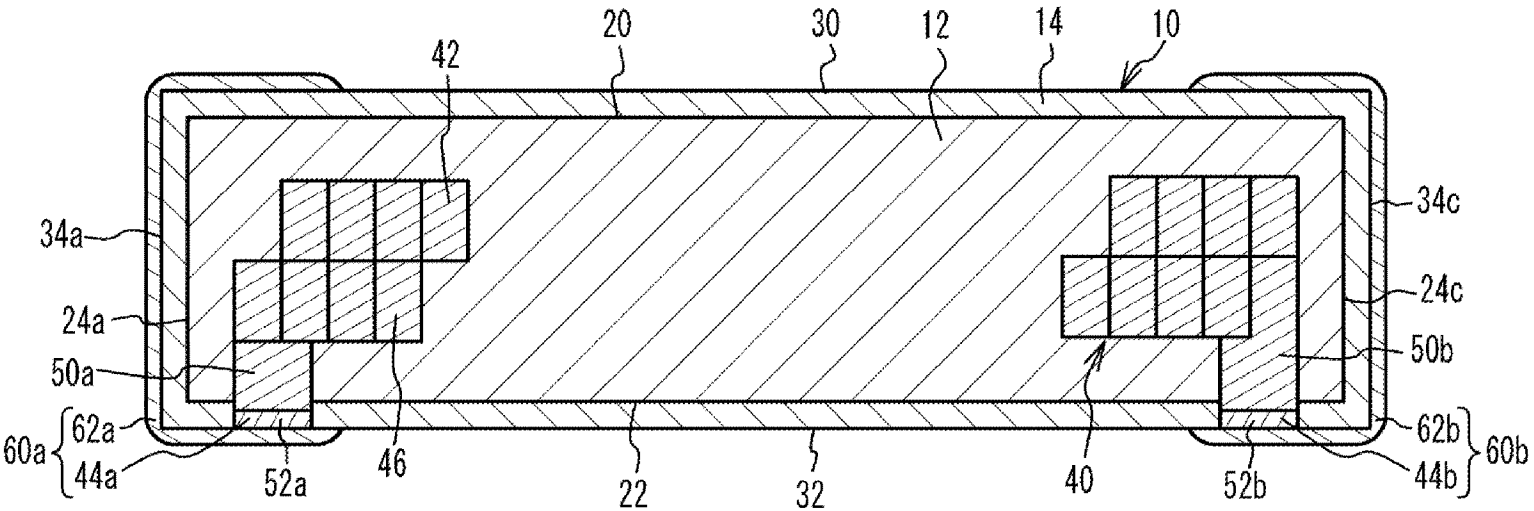
FIG. 15B is a view of cross-section A-A in FIG. 15A.

FIG. 15A is a perspective view of the coil component pertaining to Example 5, while FIG. 15B is a view of cross-section A-A in FIG. 15A. As shown in FIGS. 15A and 15B, the coil component 500 in Example 5 is such that its substrate body 10 is formed with the resin part 14 joined to all of the top face 20, bottom face 22 and side faces 24*a* to 24*d* of the resin part 12. The core 16 is not embedded in the resin part 12. The lead wires 50*a*, 50*b* are led out from the coil 40 toward the bottom face 32 of the substrate body 10. The tip areas 52*a*, 52*b*, representing the non-covered parts 44*a*, 44*b*, of the lead wires 50*a*, 50*b* are exposed from the resin part 14 on the bottom face 32 of the substrate body 10. The metal members 62*a*, 62*b* are joined to the non-covered parts 44*a*, 44*b* of the lead wires 50*a*, 50*b* exposed from the resin part 14, to form the terminal parts 60*a*, 60*b*.

The terminal part 60*a* extends from the bottom face 32, via the side face 34*a*, to the top face 30, of the substrate body 10 and also covers parts of the side faces 34*b*, 34*d*. The terminal part 60*b* extends from the bottom face 32, via the side face 34*c*, to the top face 30, of the base part 10 and also covers parts of the side faces 34*b*, 34*d*. In other words, the terminal parts 60*a*, 60*b* cover five faces of the substrate body 10. It should be noted that the terminal parts 60*a*, 60*b* may extend from the bottom face 32, via the side face 34*a* or 34*c*, to the top face 30, of the substrate body 10, thereby covering three faces of the substrate body 10. The remaining constitutions are the same as those in Example 1 and therefore not explained.

The coil component 500 in Example 5 can also prevent cracks and other damage to the substrate body 10.

Example 6

Figure 16A:
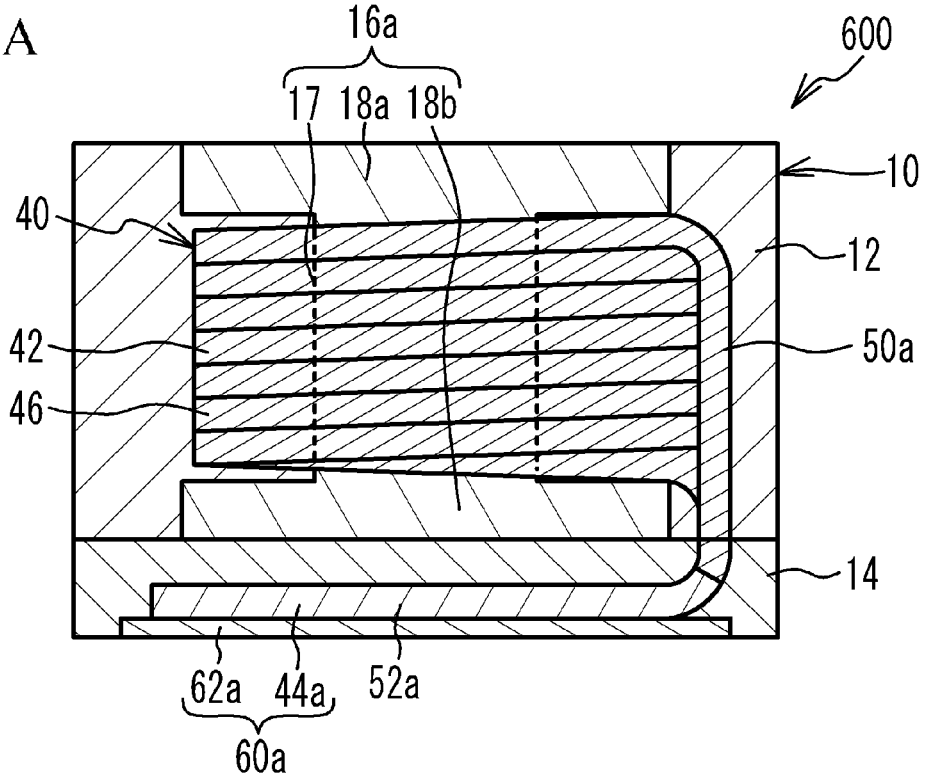
Figure 16B:
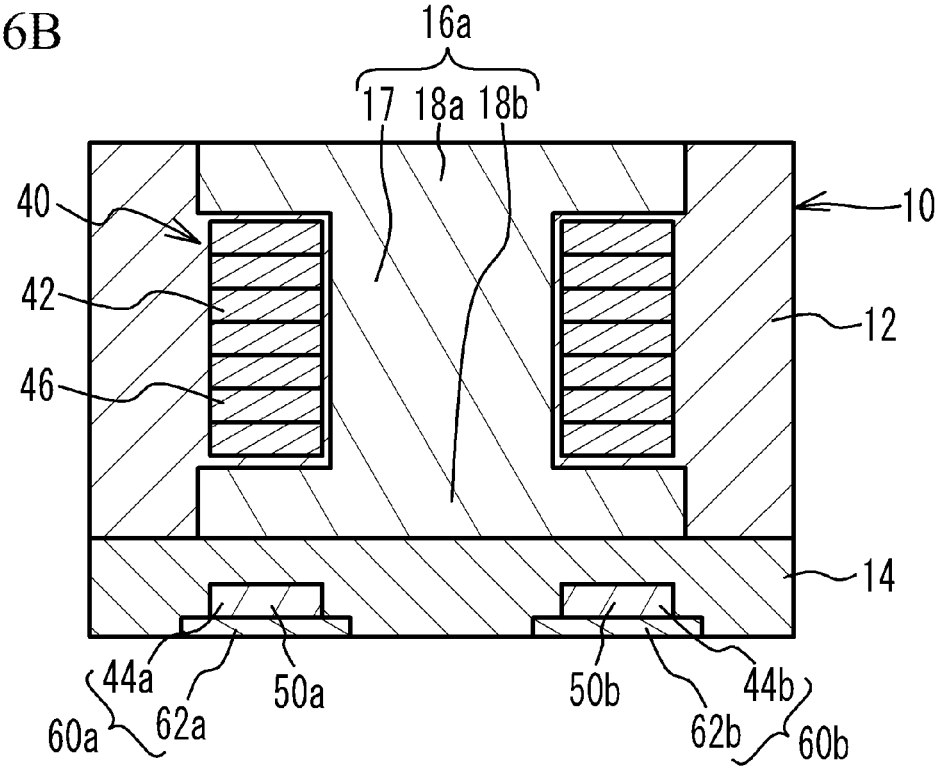
FIG. 16B is a cross-sectional view, of the coil component pertaining to Example 6.

FIG. 16A is an interior perspective side view, while FIG. 16B is a cross-sectional view, of the coil component pertaining to Example 6. It should be noted that, in FIG. 16A, each member is hatched for the purpose of illustrative clarity. As shown in FIGS. 16A and 16B, the coil component 600 in Example 6 is different from the coil component 100 in Example 1 in that the core 16*a* it uses is a drum core having flange parts 18*a*, 18*b* provided at both axial-direction ends of an axis of winding 17. The remaining constitutions are the same as those of the coil component 100 in Example 1 and therefore not explained. The coil component 600 in Example 6 may be produced by preparing beforehand a structure constituted by a coil 40 wound around a core 16*a*, which is a drum core, and, for the rest, following a manufacturing method similar to the one for the coil component 100 in Example 1.

While FIGS. 16A and 16B illustrate an example where the resin parts 12, 14 are joined together except at the bottom face of the flange part 18*b* of the core 16*a* and the bottom face of the 18*b* is joined to the resin part 14, this is not the only case. The resin part 12 may be provided in a manner covering the entire bottom face of the flange part 18*b*, with the resin part 14 joined only to the resin part 12. Also, as shown in FIG. 16A, stable connection between the tip area 52*a* of the lead wire 50*a* and the metal member 62*a* can be ensured, because the tip of the lead wire 50*a* is on the outer side of the side face of the core 16*a*. Also, while FIGS. 16A and 16B illustrate an example where the size of the flange part 18*a* is the same as that of the flange part 18*b*, their sizes may be different. By making the flange part 18*a* smaller than the flange part 18*b*, for example, a wide resin flow channel can be ensured when resin is charged, and resin parts with fewer pores can be formed with ease.

Figure 17A:
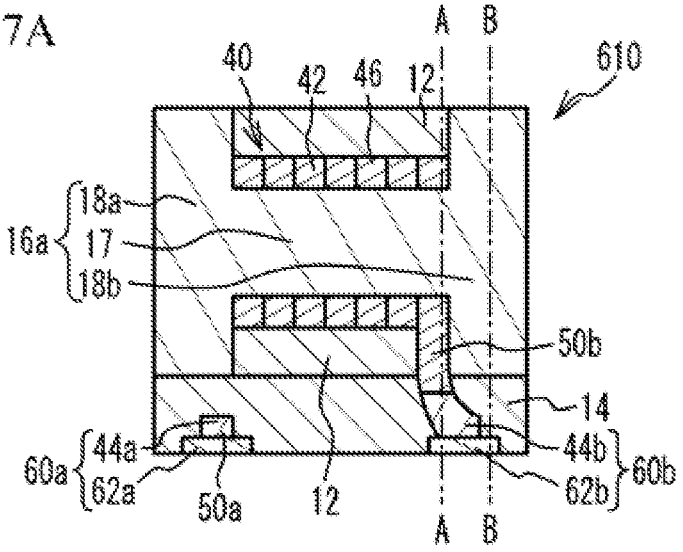
Figure 17B:
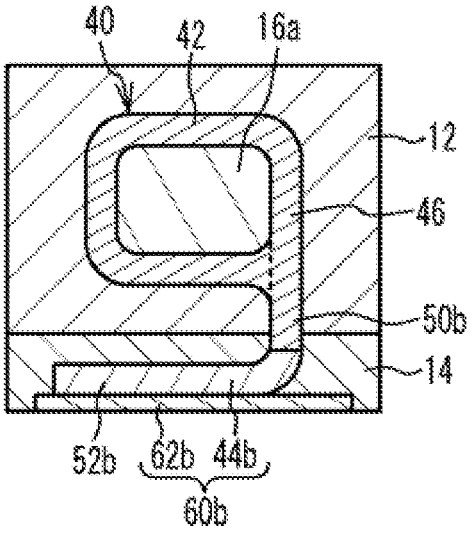
FIG. 17B is a view of cross-section A-A in FIG. 17A.
Figure 17C:
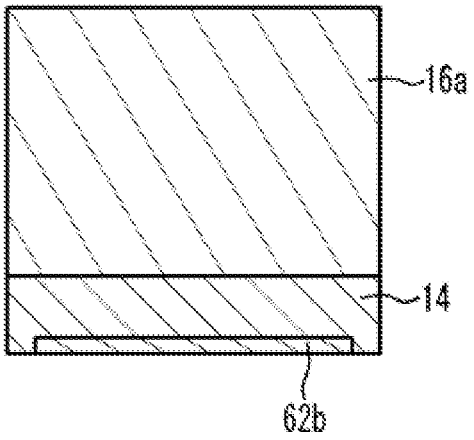
FIG. 17C is a view of cross-section B-B in FIG. 17A.

FIG. 17A is a cross-sectional view of the coil component pertaining to Variation Example 1 of Example 6, while FIG. 17B is a view of cross-section A-A in FIG. 17A, and FIG. 17C is a view of cross-section B-B in FIG. 17A. As shown in FIGS. 17A to 17C, the coil component 610 in Variation Example 1 of Example 6 is different from the coil component 600 in Example 6 in that the core 16*a* is tilted by 90°. The resin parts 12, 14 are joined together except at the side faces of the flange parts 18*a*, 18*b*, and the side faces of the flange parts 18*a*, 18*b* and the resin part 14 are joined together. It should be noted that the resin part 12 may cover the entire side faces of the flange parts 18*a*, 18*b*, with the resin part 14 joined only to the resin part 12. Also, in Example 6 and Variation Example 1 of Example 6, the electrode structure illustrated in Example 2 or 3 may be used.

Example 7

Figure 18A:
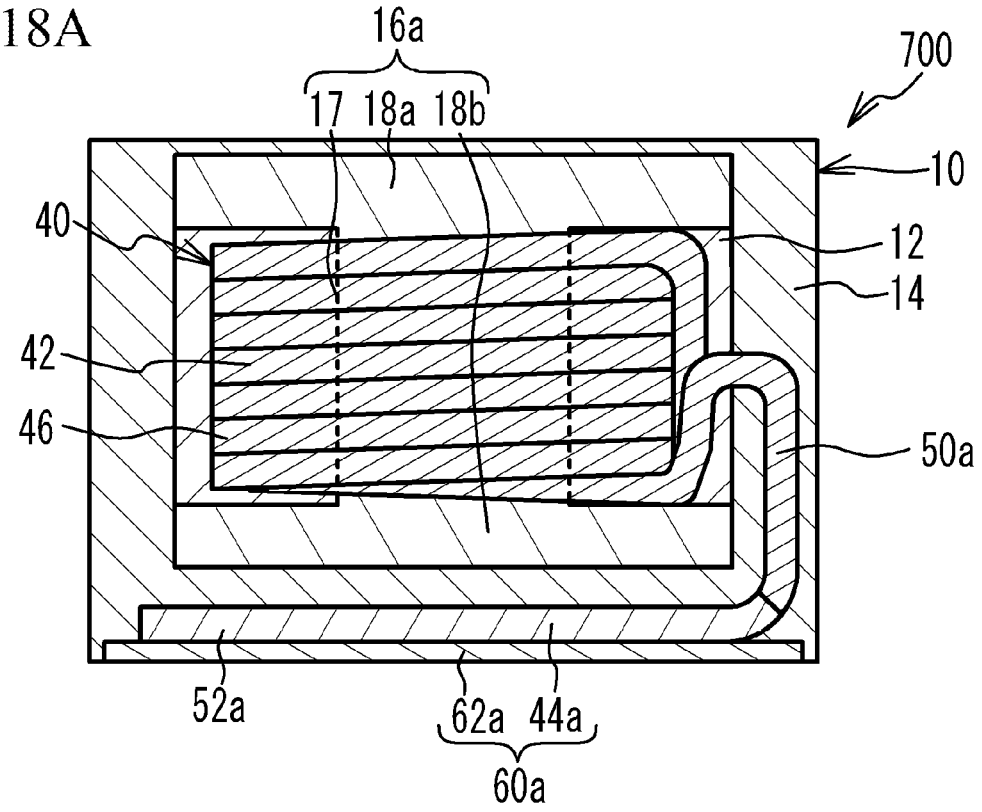
Figure 18B:
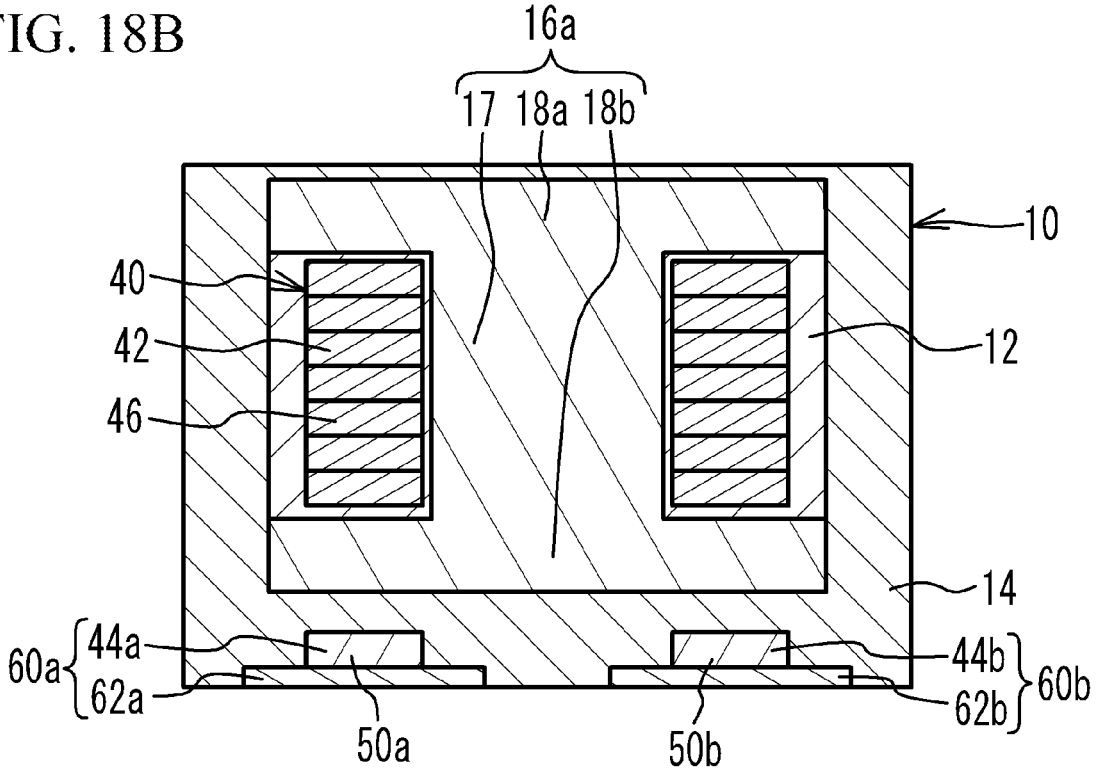
FIG. 18B is a cross-sectional view, of the coil component pertaining to Example 7.

FIG. 18A is an interior perspective side view, while FIG. 18B is a cross-sectional view, of the coil component pertaining to Example 7. It should be noted that, in FIG. 18A, each member is hatched for the purpose of illustrative clarity. As shown in FIGS. 18A and 18B, the coil component 700 in Example 7 is different from the coil component 400 in Example 4 in that the core 16*a* it uses is a drum core having flange parts 18*a*, 18*b* provided at both axial-direction ends of an axis of winding 17. The remaining constitutions are the same as those of the coil component 400 in Example 4 and therefore not explained. The coil component 700 in Example 7 may be produced by preparing beforehand a structure constituted by a coil 40 wound around a core 16*a*, which is a drum core, and, for the rest, following a manufacturing method similar to the one for the coil component 400 in Example 4.

Figure 19A:
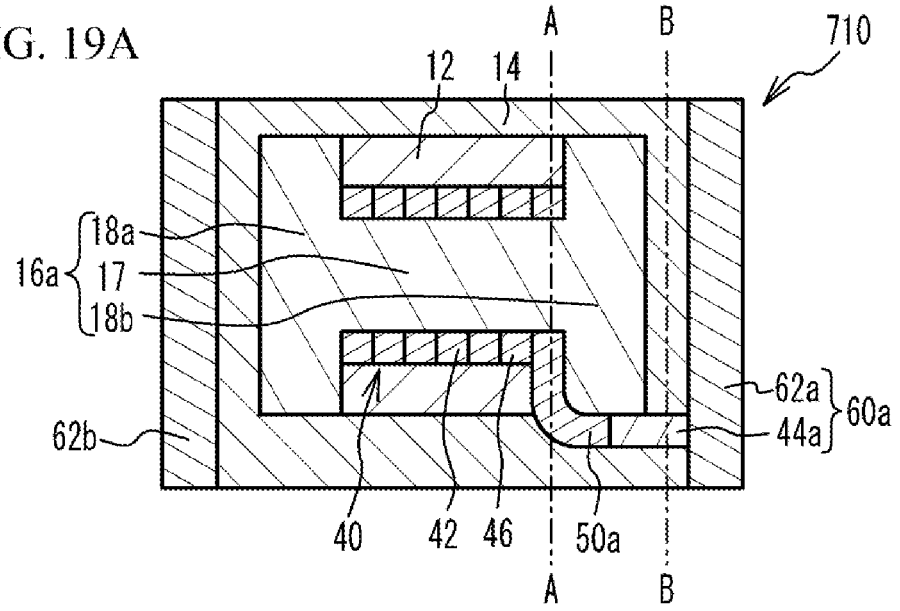
Figure 19B:
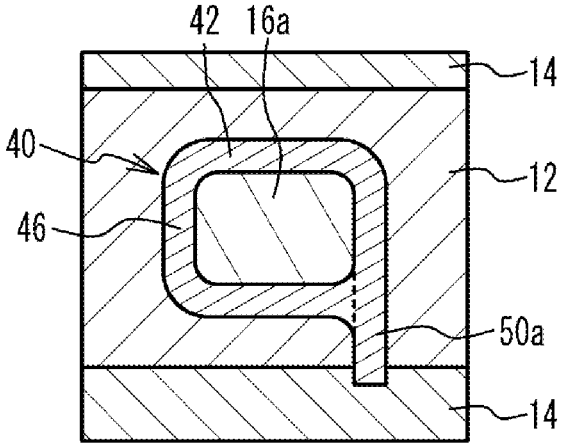
FIG. 19B is a view of cross-section A-A in FIG. 19A.
Figure 19C:
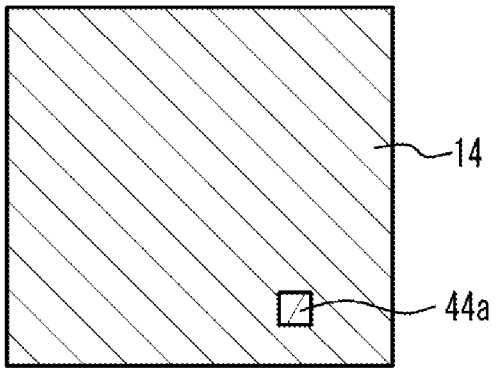
FIG. 19C is a view of cross-section B-B in FIG. 19A.

FIG. 19A is a cross-sectional view of the coil component pertaining to Variation Example 1 of Example 7, while FIG. 19B is a view of cross-section A-A in FIG. 19A, and FIG. 19C is a view of cross-section B-B in FIG. 19A. As shown in FIGS. 19A to 19C, the coil component 710 in Variation Example 1 of Example 7 is different from the coil component 700 in Example 7 in that its core 16*a* is tilted by 90° and its metal members 62*a*, 62*b* are provided separately on both side faces of the resin part 14.

Figure 20A:
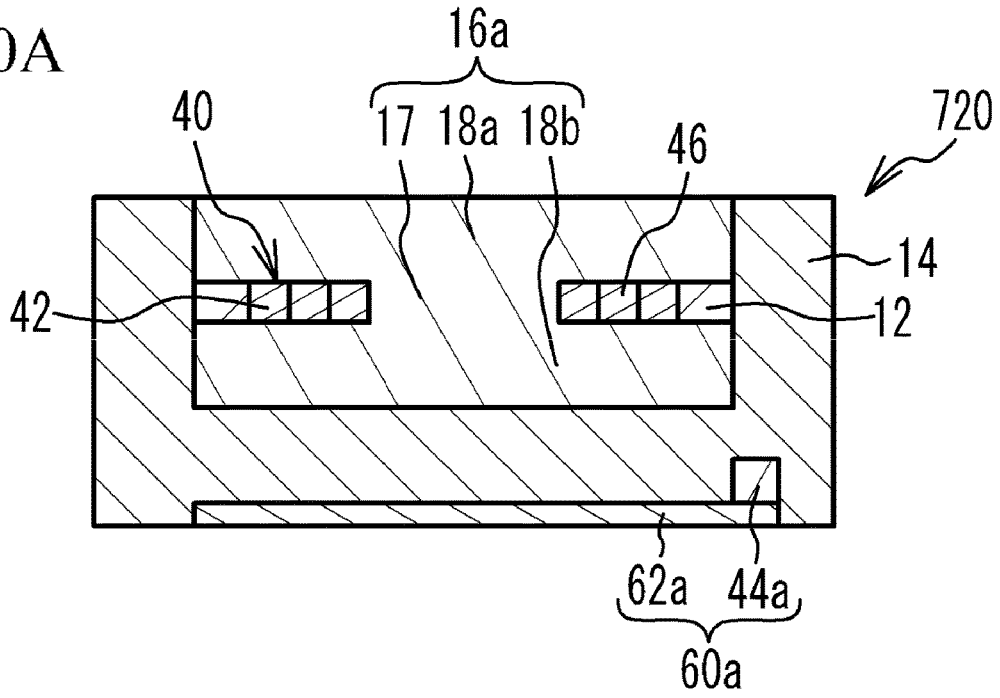
FIG. 20A is a cross-sectional view of the coil component pertaining to Variation Example 2 of Example 7, while FIG.
Figure 20B:
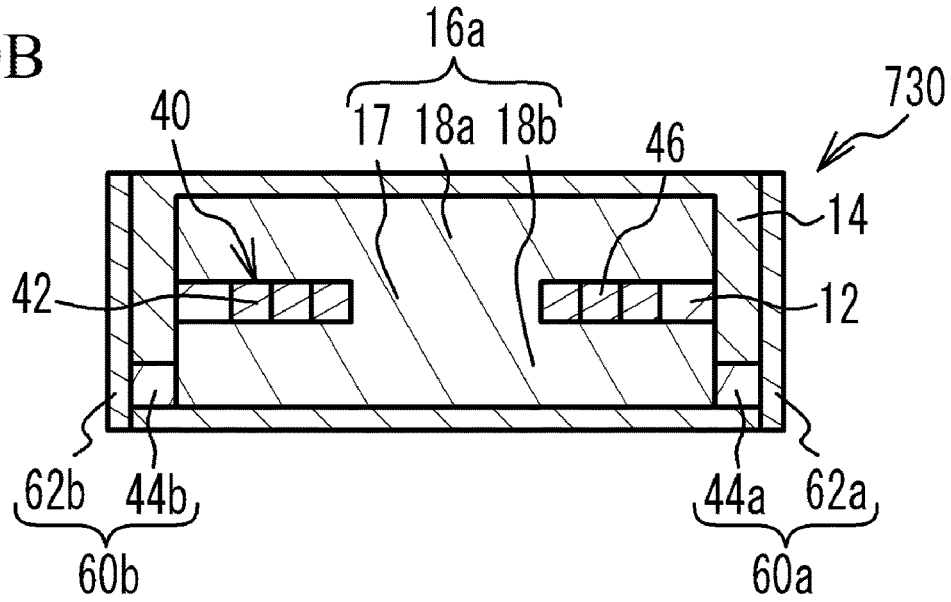

FIG. 20A is a cross-sectional view of the coil component pertaining to Variation Example 2 of Example 7, while FIG. 20B is a cross-sectional view of the coil component pertaining to Variation Example 3 of Example 7. As shown in FIG. 20A, the coil component 720 in Variation Example 2 of Example 7 is different from the coil component 700 in Example 7 in that its core 16*a* has a shorter axis of winding 17 and only one coil 40 layer is wound around the axis of winding 17. As shown in FIG. 20B, the coil component 730 in Variation Example 3 of Example 7 is different from the coil component 700 in Example 7 in that its core 16*a* has a shorter axis of winding 17, only one coil 40 layer is wound around the axis of winding 17, and its metal members 62*a*, 62*b* are provided separately on both side faces of the resin part 14.

Example 8

FIGS. 21A and 21B are interior perspective side views of the electronic device pertaining to Example 8. It should be noted that, in FIGS. 21A and 21B, each member is hatched for the purpose of illustrative clarity. As shown in FIGS. 21A and 21B, the electronic device 800 in Example 8 comprises a circuit board 80 and the coil component 100 in Example 1 that has been mounted on the circuit board 80. The coil component 100 is mounted on the circuit board 80 as a result of the joining, to the electrode 82 on the circuit board 80 via solder 84, of the terminal parts 60*a*, 60*b* constituted by the non-covered parts 44*a*, 44*b* of the lead wires 50*a*, 50*b* and metal members 62*a*, 62*b* joined to the non-covered parts 44*a*, 44*b*.

According to the electronic device in Example 8, the coil component 100 in Example 1 is mounted on a circuit board 80. This way, an electronic device 800 having a coil component 100 resistant to damage can be obtained. It should be noted that, while Example 8 illustrated an example where the coil component 100 in Example 1 is mounted on a circuit board 80, any of the coil components in Variation Example 1 of Example 1 to Variation Example 3 of Example 7 may be mounted.

The foregoing described the examples of the present invention in detail; however, the present invention is not limited to these specific examples and a number of different variations and modifications are possible to the extent that doing so does not deviate from the key points of the present invention as described in What Is Claimed Is. For example, other examples include forming a coil by means of plating to produce a flat coil, as well as forming each resin part as a layer by means of printing or sheet forming, as they permit production of particularly thin coil components.

I claim:

1. A coil component, comprising:

a substrate body having a first resin part formed by a resin that contains multiple magnetic grains, and a second resin part joined to a surface of the first resin part and formed by a resin that contains multiple filler particles, wherein (i) a resin content by volume of the second resin part is higher than that of the first resin part, (ii) the multiple filler particles are not magnetic grains and have better insulation than magnetic grains, (iii) the multiple filler particles contained in the second resin part have a lower linear expansion coefficient than that of the multiple magnetic grains contained in the first resin part, and (iv) a thermal expansion coefficient of the second resin part is adjusted in a range of equal to or higher than 100% but no higher than 120% of a thermal expansion coefficient of the first resin part;

a coil embedded at least in a part of the first resin part and formed by a conductor having an insulating film;

leader parts formed by the conductor and led out from the coil to the second resin part; and terminal parts connected electrically to the leader parts and provided in the second resin part, wherein the first resin part is entirely enclosed by the second resin part.

2. The coil component according to claim 1, wherein a resin content in the second resin part is 25 percent by volume or higher but lower than 90 percent by volume.

3. The coil component according to claim 1, wherein a resin content in the first resin part is lower than 25 percent by volume.

4. The coil component according to claim 1, wherein the second resin part is disposed between the terminal parts and the first resin part.

5. The coil component according to claim 1, wherein an average particle size of the multiple filler particles contained in the second resin part is smaller than an average grain size of the multiple magnetic grains contained in the first resin part.

6. The coil component according to claim 1, wherein the first resin part has a bottom face, a top face, and side faces, and the second resin part is joined to all areas of the bottom face, the top face, and the side faces of the first resin part.

7. The coil component according to claim 1, wherein the substrate body is formed by integrally molding the first resin part and the second resin part.

8. The coil component according to claim 7, wherein the resin that forms the first resin part, and the resin that forms the second resin part, are constituted by a same resin material.

9. The coil component according to claim 1, wherein the terminal parts are constituted by non-covered parts of the leader parts which are not covered by the insulating film, and metal members joined to the non-covered parts.

10. The coil component according to claim 1, wherein the terminal parts are constituted by non-covered parts of the leader parts which are not covered by the insulating film.

11. The coil component according to claim 1, wherein surfaces of the terminal parts are roughly flush with a surface of the second resin part on a mounting-surface side.

12. An electronic device comprising:

the coil component according to claim 1; and a circuit board on which the coil component has been mounted.

13. The coil component according to claim 1, wherein the multiple filler particles include silicon oxide, aluminum oxide, titanium oxide, or zinc oxide.

14. The coil component according to claim 1, wherein the leader parts are embedded in the second resin part.

15. The coil component according to claim 1, wherein the second resin part does not contain magnetic grains.

16. The coil component according to claim 1, wherein a resin content in the first resin part is lower than 25% by volume, and a resin content in the second resin part is 40% or higher by volume.

17. The coil component according to claim 16, wherein the resin content in the first resin part is lower than 15% by volume, and the resin content in the second resin part is 50% or higher by volume.

* * * * *